US009903111B1

(12) United States Patent
Nir et al.

(10) Patent No.: US 9,903,111 B1
(45) Date of Patent: Feb. 27, 2018

(54) CONSTRUCTION ASSEMBLY AND METHOD FOR LAYING BLOCKS

(71) Applicants: Orial Nir, Moshav Nachliel (IL); Yair Sandorffy, Moshav Nachliel (IL)

(72) Inventors: Orial Nir, Moshav Nachliel (IL); Yair Sandorffy, Moshav Nachliel (IL)

( * ) Notice: Subject to any disclaimer, the term of this patent is extended or adjusted under 35 U.S.C. 154(b) by 0 days.

(21) Appl. No.: 15/431,820

(22) Filed: Feb. 14, 2017

(51) Int. Cl.

| | |
|---|---|
| ***E04B 2/18*** | (2006.01) |
| ***E04B 2/26*** | (2006.01) |
| ***E04G 21/18*** | (2006.01) |
| *E01C 5/08* | (2006.01) |
| *E04B 2/02* | (2006.01) |

(52) U.S. Cl.
CPC ..... *E04B 2/18* (2013.01); *E04B 2/26* (2013.01); *E04G 21/1808* (2013.01); *E04G 21/1841* (2013.01); *E01C 5/08* (2013.01); *E04B 2002/0204* (2013.01); *E04B 2002/0243* (2013.01)

(58) Field of Classification Search
CPC ..... E04B 2/18; E04B 2/26; E04B 2002/0243; E04B 2002/0204; E04G 21/1808; E04G 21/1841; E01C 5/08
See application file for complete search history.

(56) References Cited

U.S. PATENT DOCUMENTS 860,927 A * 7/1907 Mann ..... E04B 1/4178 425/DIG. 126
966,801 A * 8/1910 Daisly ..... E04G 21/1808 182/130
2,042,438 A * 5/1936 Wells ..... E04L 32/845 52/333
2,331,657 A * 10/1943 Crom ..... E04G 11/06 264/32
2,440,754 A * 5/1948 Nagel ..... B28B 1/20 165/56
2,518,186 A * 8/1950 Rumble ..... E04B 2/86 249/182
2,685,194 A * 8/1954 Amirikian ..... E04B 1/20 52/223.9

(Continued)

FOREIGN PATENT DOCUMENTS

| | | | | |
|---|---|---|---|---|
| CA | 2886517 A1 * | 3/2014 | ..... | E04B 2/18 |
| FR | 2502220 A1 * | 9/1982 | ..... | E04B 1/163 |
| WO | WO-9728324 A1 * | 8/1997 | ..... | E04B 2/26 |

*Primary Examiner* — Jeanette E Chapman
(74) *Attorney, Agent, or Firm* — Mark M. Friedman

(57) ABSTRACT

A construction assembly includes two frame members. A segment of one frame member contacts a surface of a contour of a first column. A segment of the other frame member contacts a surface of a contour of a second column. The surface of the contour of the second column aligns with the surface of the contour of the first column. A connector beam has a planar surface substantially perpendicular to a base surface from which the first and second columns extend. A first end portion of the connector beam couples to one frame member, and a second end portion of the connector beam couples to the other frame member. When coupled to the frame members, the connector beam substantially aligns with, and extends laterally between, the frame members. The connector beam receives blocks such that the planar surface is at a direct abutment with a planar surface of each block.

12 Claims, 25 Drawing Sheets

(56) References Cited

U.S. PATENT DOCUMENTS 2,858,613 A * 11/1958 Best ..... E04G 21/1808 33/407
2,894,641 A * 7/1959 Edwards, Jr. ..... A47B 47/022 211/134
3,127,995 A * 4/1964 Mosinski ..... A47B 57/402 211/182
3,197,171 A * 7/1965 Michalak ..... E04C 5/168 249/40
3,236,924 A * 2/1966 McClarney ..... E04G 21/22 264/261
3,238,589 A * 3/1966 McClarney ..... E04G 21/22 264/261
3,438,161 A * 4/1969 Koch ..... E04B 2/84 249/40
3,785,312 A * 1/1974 Schneider ..... B63L 335/38 114/266
3,807,681 A * 4/1974 Kane ..... E04G 9/08 249/176
3,830,678 A * 8/1974 Behunin ..... E04C 2/041 156/349
3,881,714 A * 5/1975 Wilnau ..... E04C 2/041 269/13
3,948,012 A * 4/1976 Papayoti ..... E04L 31/19 52/263
4,002,856 A * 1/1977 Sedlacek ..... H04Q 1/064 361/827
4,091,594 A * 5/1978 Yamashita ..... E04B 1/2403 52/283
4,305,239 A * 12/1981 Geraghty ..... E04B 1/41 52/379
4,454,702 A * 6/1984 Bonilla-Lugo ..... E04L 32/847 52/251
4,530,191 A * 7/1985 Boisbluche ..... E04C 2/34 52/309.11
4,678,157 A * 7/1987 Fondiller ..... B28B 1/32 249/65
5,335,472 A * 8/1994 Phillips ..... E04L 32/845 52/259
5,347,703 A * 9/1994 Imashimizu ..... B63B 3/00 29/462
5,398,470 A * 3/1995 Ritter ..... E04L 35/38 52/309.11
5,537,805 A * 7/1996 Allman ..... E04G 21/1841 33/518
5,761,876 A * 6/1998 Keady ..... E04G 21/1841 33/406
5,809,725 A * 9/1998 Cretti ..... E04B 2/8647 52/309.15
5,839,251 A * 11/1998 Weinstein ..... C04B 40/0616 52/127.1
5,855,075 A * 1/1999 DiGiovanni ..... E04F 13/0862 33/518
5,867,948 A * 2/1999 Liu ..... E04L 31/3205 52/656.9
5,937,610 A * 8/1999 Behunin ..... E04G 21/1841 52/741.1
6,041,567 A * 3/2000 Passeno ..... B28B 19/0061 249/96
6,705,055 B2 * 3/2004 Ritter ..... E04C 2/044 52/309.11
6,973,864 B1 * 12/2005 Ahmad ..... E04H 9/10 52/454
7,516,589 B2 * 4/2009 Messiqua ..... E04B 2/8658 52/415
7,562,613 B2 * 7/2009 Ahmad ..... E04H 9/10 428/911
7,934,693 B2 * 5/2011 Bravinski ..... E04B 2/8647 249/216
8,490,352 B2 * 7/2013 Trimmer ..... E04C 2/044 52/220.1
8,616,520 B2 * 12/2013 Baader ..... E04B 2/8647 249/216
8,627,629 B2 * 1/2014 Tims ..... E04B 2/26 52/405.1
8,640,422 B2 * 2/2014 Vandehey ..... E04F 13/0887 52/405.1
8,756,890 B2 * 6/2014 Ciuperca ..... E04B 1/21 249/190
9,593,487 B2 * 3/2017 Harvey ..... E04B 2/10
2001/0039741 A1 * 11/2001 Kirk ..... E04G 21/1841 33/408
2003/0192272 A1 * 10/2003 Bravinski ..... E04B 2/8635 52/309.11
2004/0025466 A1 * 2/2004 Hink ..... E04H 5/12 52/645
2016/0069063 A1 * 3/2016 Harvey ..... E04B 2/10 52/125.2
2017/0159529 A1 * 6/2017 Kleuderlein ..... F16L 13/02

* cited by examiner

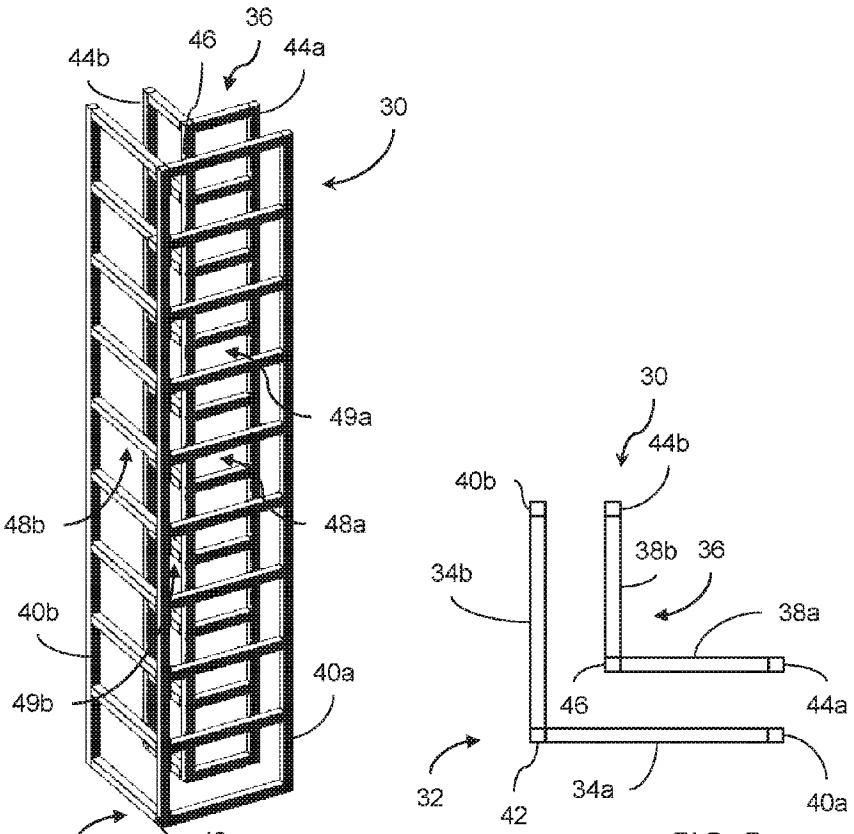
FIG. 5
FIG. 4
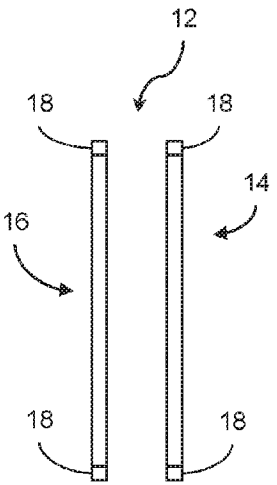
FIG. 3
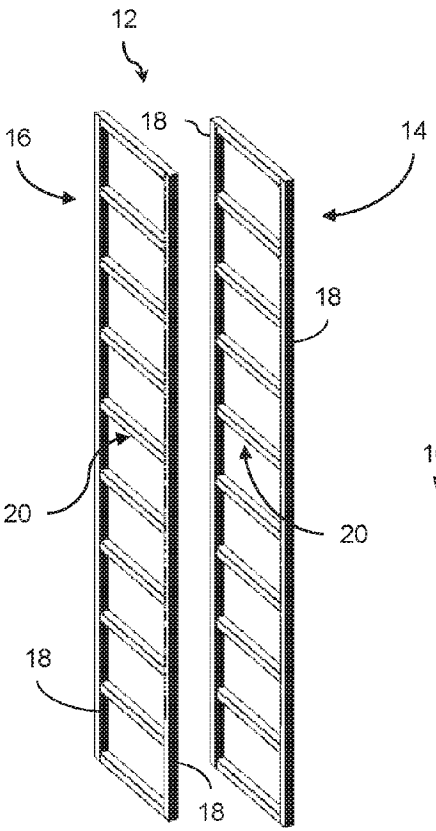
FIG. 2

CONSTRUCTION ASSEMBLY AND METHOD FOR LAYING BLOCKS

TECHNICAL FIELD

The present invention relates to building construction using block laying techniques.

BACKGROUND OF THE INVENTION

Concrete based construction of buildings, and more particularly concrete based construction of single family residential buildings, often rely on a combination of concrete support structures and concrete construction blocks, often referred to as masonry blocks or concrete masonry units. Concrete construction blocks are typically fabricated using a mixture of cement, different aggregates (e.g., stone or quartz), and water. The lightweight and durable features of concrete construction blocks provide a cost-effective solution for building construction. Concrete construction blocks may be hollow, solid, porous, or a combination therebetween (i.e., including voids), depending on the type of wall to be constructed. For example, solid blocks may be preferred when constructing an external peripheral wall of a building to provide better insulation, whereas hollow or partially hollow construction blocks may be used when constructing internal walls of a building.

The walls of the building are typically built primarily from the concrete construction blocks, which extend in layered rows between adjacent concrete columns. However, concrete construction blocks are typically hand laid by construction workers, requiring precise positioning and measurement during, and prior to, the placement of the concrete construction blocks. Such hand laying introduces human error, and in many instances, the layered rows of construction blocks are misaligned, requiring alignment adjustment, resulting in increased cost for construction and time to completion.

SUMMARY OF THE INVENTION

The present invention is a construction assembly and method for laying blocks.

According to the teachings of an embodiment of the present invention, there is provided a construction assembly. The construction assembly comprises: a first frame module comprising a first frame member including a segment for contacting a first surface of a contour of a first column; a second frame module comprising a first frame member including a segment for contacting a first surface of a contour of a second column substantially aligned with the first surface of the contour of the first column; and at least one first connector beam including first and second end portions and a planar surface substantially perpendicular to a base surface from which the first and second columns extend, the first end portion operatively coupled to the first frame member of the first frame module, and the second end portion operatively coupled to the first frame member of the second frame module, the at least one first connector beam substantially aligned with, and extending laterally between, the first frame members of the first and second frame modules, the at least one first connector beam receiving at least one block such that the planar surface is at a direct abutment with a first planar surface of the at least one block.

Optionally, the construction assembly further comprises: at least one first frame module attachment mechanism coupled to the first frame member of the first frame module for facilitating the operative coupling of the first end portion to the first frame member of the first frame module; and at least one second frame module attachment mechanism coupled to the first frame member of the second frame module for facilitating the operative coupling of the second end portion to the first frame member of the second frame module.

Optionally, the at least one first frame module attachment mechanism is coupled to the first frame member of the first frame module at an adjustable position along an axis substantially perpendicular to the base surface, and the at least one second frame module attachment mechanism is coupled to the first frame member of the second frame module at an adjustable position along an axis substantially perpendicular to the base surface.

Optionally, the at least one first frame module attachment mechanism includes a plurality of first frame module attachment mechanisms, each coupled to the first frame member of the first frame module at an adjustable position along an axis substantially perpendicular to the base surface, and the at least one second frame module attachment mechanism includes a plurality of second frame module attachment mechanisms, each coupled to the first frame member of the second frame module at an adjustable position along an axis substantially perpendicular to the base surface.

Optionally, the at least one first connector beam includes a plurality of first connector beams, each first end portion of the first connector beams being operatively coupled to a respective one of the first frame module attachment mechanisms, and each second end portion of the first connector beams being operatively coupled to a respective one of the second frame module attachment mechanisms.

Optionally, the first frame module further comprises a second frame member including a segment for contacting a second surface of the contour of the first column, and the second frame module further comprises a second frame member including a segment for contacting a second surface of the contour of the second column, and at least one of the second surface of the contour of the first column is oppositely disposed from the first surface of the contour of the first column or the second surface of the contour of the second column is oppositely disposed from the first surface of the contour of the second column.

Optionally, the construction assembly further comprises: at least one second connector beam including first and second end portions and a planar surface substantially perpendicular to the base surface and parallel to the planar surface of the at least one first connector beam, the first end portion of the at least one second connector beam operatively coupled to the second frame member of the first frame module, and the second end portion of the at least one second connector beam operatively coupled to the second frame member of the second frame module, the at least one second connector beam substantially aligned with, and extending laterally between, the second frame members of the first and second frame modules, the at least one second connector beam positioned such that the planar surface of the at least one second connector beam is at a direct abutment with a second planar surface of the at least one block, the first and second planar surfaces of the at least one block being oppositely disposed.

Optionally, the first and second frame members of the first frame module are deployed in spaced relation so as to at least partially encase the contour of the first column, and the first and second frame members of the second frame module are deployed in spaced relation so as to at least partially encase the contour of the second column.

Optionally, the construction assembly further comprises: at least one first frame module fastening and tightening mechanism for coupling the first and second frame members of the first frame module to each other, and for adjusting the spacing between the first and second frame members of the first frame module; and at least one second frame module fastening and tightening mechanism for coupling the first and second frame members of the second frame module to each other, and for adjusting the spacing between the first and second frame members of the second frame module.

Optionally, at least one of the first frame member of the first frame module or the first frame member of the second frame module includes a second segment axially joined with the segment for contacting the first surface of the contour of the respective column so as to form a substantially perpendicular joint.

Optionally, at least one of the contours of the first and second columns is formed from a material selected from the group consisting of: wood, tin, or concrete.

There is also provided according to an embodiment of the teachings of the present invention, a method for laying blocks. The method comprises: deploying a first frame member of a first frame module by placing a segment of the first frame member in contact with a first surface of a contour of a first column; deploying a first frame member of a second frame module by placing a segment of the first frame member of the second frame module in contact with a first surface of a contour of a second column, wherein the first surfaces of the contours of the first and second column are substantially aligned; coupling a first end portion of a first connector beam to the first frame member of the first frame module, and coupling a second end portion of the first connector beam to the first frame member of the second frame module, such that the first connector beam is substantially aligned with, and extends laterally between, the first frame members of the first and second frame modules; and positioning at least one first block such that a first planar surface of the at least one first block is at a direct abutment with a planar surface of the at least one first connector beam, the planar surface being substantially perpendicular to a base surface from which the first and second columns extend.

Optionally, the method further comprises: deploying a second frame member of the first frame module by placing a segment of the second frame member in contact with a second surface of the contour of the first column; deploying a second frame member of the second frame module by placing a segment of the second frame member of the second frame module in contact with a second surface of the contour of the second column, wherein at least one of the second surface of the contour of the first column is oppositely disposed from the first surface of the contour of the first column or the second surface of the contour of the second column is oppositely disposed from the first surface of the contour of the second column; and coupling a first end portion of a second connector beam to the second frame member of the first frame module, and coupling a second end portion of the second connector beam to the second frame member of the second frame module, such that the at second connector beam is substantially aligned with, and extends laterally between, the second frame members of the first and second frame modules, and such that a planar surface of the second connector beam is at a direct abutment with a second planar surface of the at least one first block, the planar surface of the second connector beam being substantially perpendicular to the base surface and parallel to the planar surface of the first connector beam, and the first and second planar surfaces of the at least one first block being oppositely disposed.

Optionally, the method further comprises: pouring a cement based mixture into at least a portion of the spaces defining the contours of the first and second column; and allowing the cement based mixture to set and solidify to define the shape of the first and second columns.

Optionally, the first and second frame members of the first frame module are deployed in spaced relation so as to at least partially encase the contour of the first column, and the first and second frame members of the second frame module are deployed in spaced relation so as to at least partially encase the contour of the second column.

Optionally, the method further comprises: coupling the first and second frame members of the first frame module to each other and adjusting the spacing between the first and second frame members of the first frame module, and coupling the first and second frame members of the second frame module to each other and adjusting the spacing between the first and second frame members of the second frame module.

Optionally, the at least one first block includes a plurality of first blocks, and the positioning of the plurality first block includes: arranging the plurality of first blocks in a row such that at least one planar surface of each of the first blocks, substantially perpendicular to the first planar surface of the respective first block, is at a direct abutment with at least one planar surface of an adjacent first block, wherein the row extends laterally substantially between the first and second columns.

Optionally, each of the first blocks includes a second planar surface oppositely disposed from, and substantially parallel to, the first planar surface of the respective each first block, and the method further comprises: deploying a second frame member of the first frame module by placing a segment of the second frame member in contact with a second surface of the contour of the first column; deploying a second frame member of the second frame module by placing a segment of the second frame member of the second frame module in contact with a second surface of the contour of the second column, wherein at least one of the second surface of the contour of the first column is oppositely disposed from the first surface of the contour of the first column or the second surface of the contour of the second column is oppositely disposed from the first surface of the contour of the second column; and coupling a first end portion of a second connector beam to the second frame member of the first frame module, and coupling a second end portion of the second connector beam to the second frame member of the second frame module, such that the second connector beam is substantially aligned with, and extends laterally between, the second frame members of the first and second frame modules, and such that a planar surface of the second connector beam is at a direct abutment with the second planar surfaces of the first blocks, the planar surface of the second connector beam being substantially perpendicular to the base surface and parallel to the planar surface of the first connector beam.

Optionally, the method further comprises: deploying a subsequent first connector beam in spaced relation with, and parallel to, the first connector beam by coupling a first end portion of the subsequent first connector beam to the first frame member of the first frame module, and coupling a second end portion of the subsequent first connector beam to the first frame member of the second frame module, such that the subsequent first connector beam is substantially aligned with, and extends laterally between, the first frame members of the first and second frame modules; arranging a subsequent plurality of blocks in a subsequent row at a direct abutment with the arranged row of blocks, each of the subsequent blocks including oppositely disposed first and second planar surfaces, each of the first planar surfaces being at a direct abutment with a planar surface of the subsequent first connector beam; and deploying a subsequent second connector beam in spaced relation with, and parallel to, the second connector beam by coupling a first end portion of the subsequent second connector beam to the second frame member of the first frame module, and coupling a second end portion of the subsequent second connector beam to the second frame member of the second frame module, such that the subsequent second connector beam is substantially aligned with, and extends laterally between, the second frame members of the first and second frame modules, and such that a planar surface of the subsequent second connector beam is at a direct abutment with the second planar surface of each of the subsequent blocks.

There is also provided according to an embodiment of the teachings of the present invention, a construction assembly. The construction assembly comprises: a first pair of frame members contacting oppositely disposed surfaces of a contour of a first column so as to at least partially encase the contour of the first column; a second pair of frame members contacting oppositely disposed surfaces of a contour of a second column so as to at least partially encase the contour of the second column; and a pair of connector beams, each of the connector beams including a planar surface substantially perpendicular to a base surface from which the first and second columns extend, one connector beam of the pair of connector beams being substantially aligned with, and extending laterally between, one frame member of the first pair of frame members and one frame member of the second pair of frame members, the other connector beam of the pair of connector beams being substantially aligned with, and extending laterally between, the other frame member of the first pair of frame members and the other frame member of the second pair of frame members, the pair of connector beams being deployed such that, the planar surface of one connector beam of the pair of connector beams is at a direct abutment with a first planar surface of at least one block, and such that the planar surface of the other connector beam of the pair of connector beams is at a direct abutment with a second planar surface of the at least one block.

Unless otherwise defined herein, all technical and/or scientific terms used herein have the same meaning as commonly understood by one of ordinary skill in the art to which the invention pertains. Although methods and materials similar or equivalent to those described herein may be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the present invention are herein described, by way of example only, with reference to the accompanying drawings. With specific reference to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

Attention is now directed to the drawings, where like reference numerals or characters indicate corresponding or like components. In the drawings:

FIG. 2 is an isometric view illustrating a pair of frame members of a frame module of the construction assembly, according to the teachings of an embodiment of the present invention;

FIG. 3 is a top view corresponding to FIG. 2, according to the teachings of an embodiment of the present invention;

FIG. 4 is an isometric view illustrating a pair of frame members of an L-frame module of the construction assembly, according to the teachings of an embodiment of the present invention;

FIG. 5 is a top view corresponding to FIG. 4;

DESCRIPTION OF THE PREFERRED EMBODIMENTS

Figure 1:
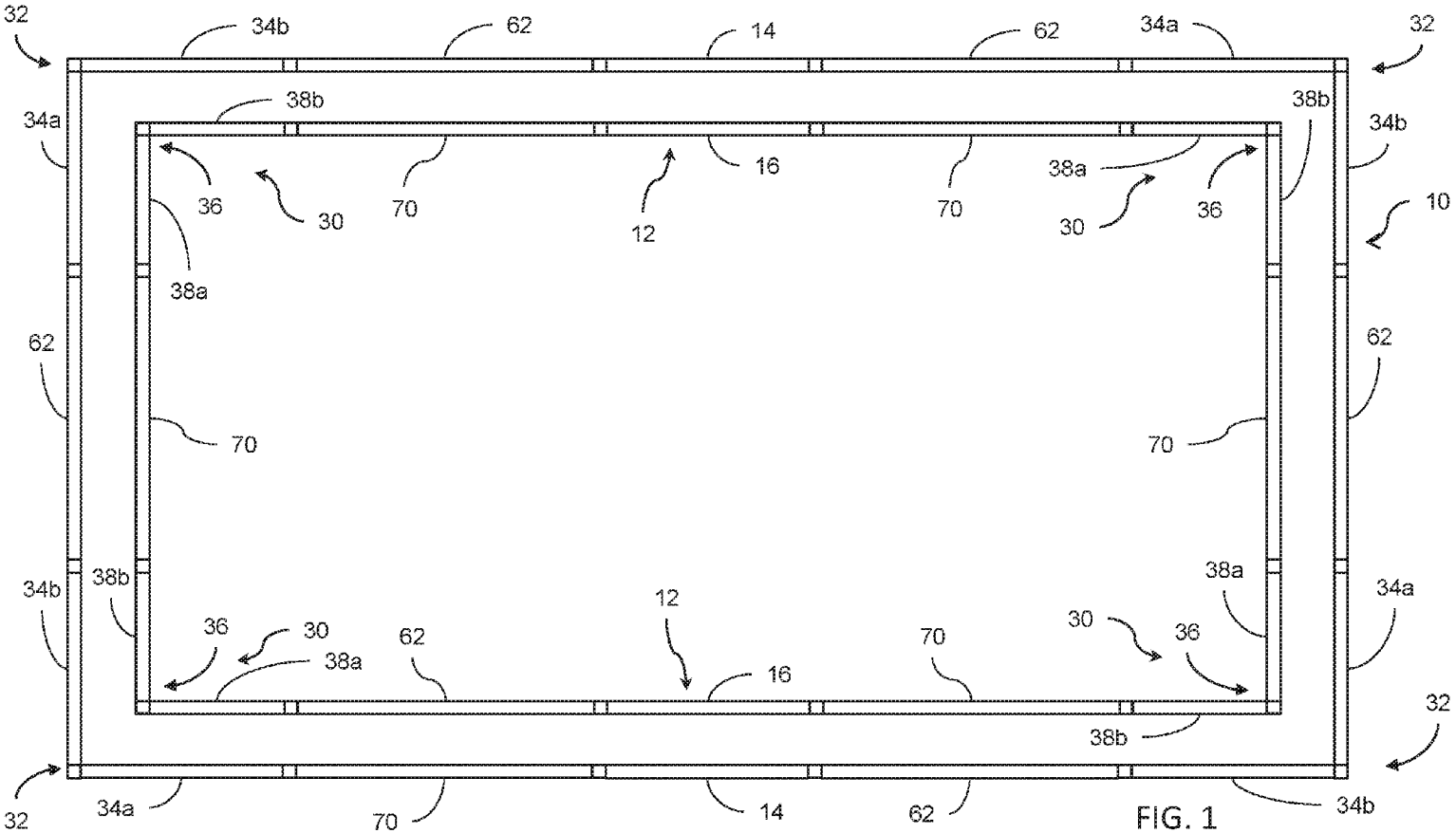
FIG. 1 is a top view illustrating a schematic representation of an example deployment of a construction assembly, constructed and operative according to the teachings of an embodiment of the present invention.

The present invention is a construction assembly and method for laying blocks.

Within the context of this document, the terms block, brick, construction block, concrete construction block, masonry block, and concrete masonry unit, are used interchangeably, and generally refer to any solid unit which can be used to construct a segment or section of a wall.

The principles and operation of the device according to the present invention may be better understood with reference to the drawings and accompanying description.

The present invention is applicable to the construction of walls built from blocks of various geometric configurations in which at least two surface of a block are parallel to each other, and is of particular value when applied to blocks which are generally cuboid in shape, such as rectangular cuboids and square cuboids. Such types of blocks include, but are not limited to, blocks having one or more scored or concave flute grooves, mortar grooves, dash grooves, plain ends, rectangular cores, pear cores, or split faces.

Before explaining at least one embodiment of the invention in detail, it is to be understood that the invention is not necessarily limited in its application to the details of construction and the arrangement of the components and/or methods set forth in the following description and/or illustrated in the drawings and/or the examples. The invention is capable of other embodiments or of being practiced or carried out in various ways. Initially, throughout this document, references are made to directions such as, for example, front and rear, top and bottom, and the like. These directional references are exemplary only to illustrate the invention and embodiments thereof.

Figure 25:
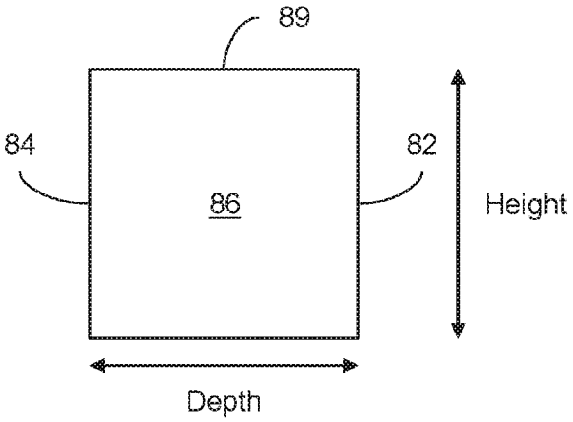
FIG. 25 is a front view corresponding to FIG. 24.
Figure 24:
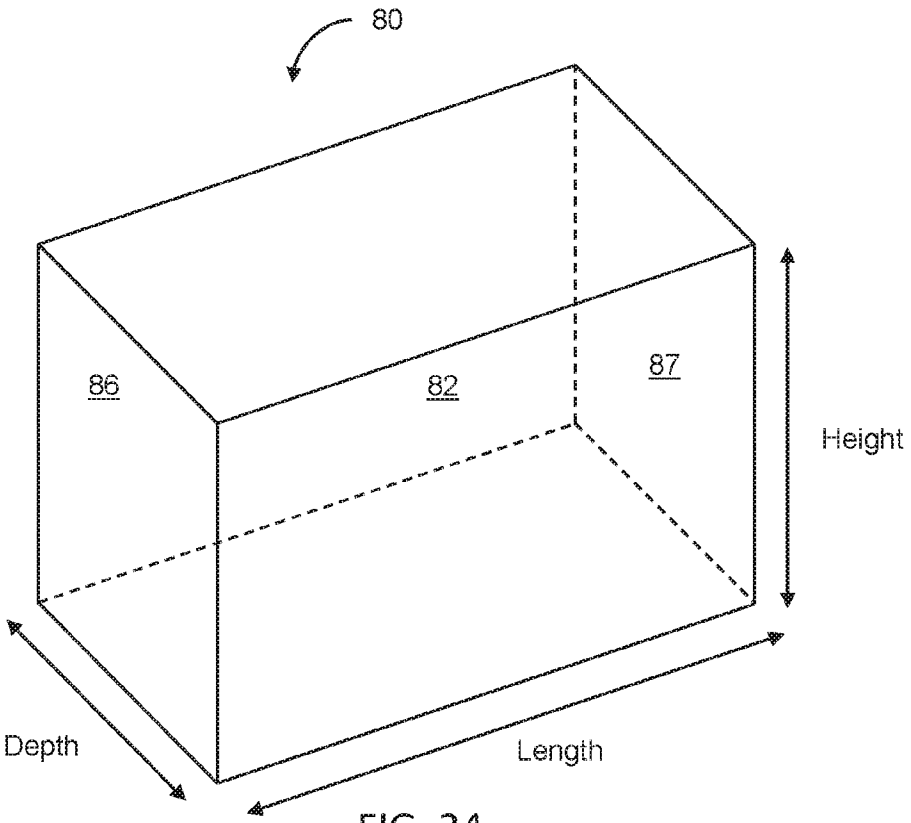
FIG. 24 is an isometric view illustrating a schematic representation of a prior art construction block.

The construction assembly of the present disclosure is used for sequentially laying blocks, each of the blocks being, for example, a block 80 schematically represented in FIGS. 24 and 25, in order to construct external and internal walls of a structure, such as, for example, a residential building. As discussed above, the block 80 is typically fabricated using a mixture of cement, different aggregates (e.g., stone or quartz), and water. Note that the depiction of the block 80 as a square cuboid is for illustration purposes only, and the block 80 may be of various geometric shapes, and may include slits and grooves, as mentioned above.

Each wall of the structure is terminated by two edge concrete columns and extends at least between the two edge concrete columns, depending on construction requirements. For example, load-bearing requirements may dictate that a wall extend between two edge concrete columns with one or more additional concrete column deployed for load-bearing support between the two edge concrete columns, resulting in a wall having multiple sections. In many instances, at least one of the edge concrete columns forms the base of a corner of a wall. As such, each section of a wall is anchored by two concrete columns, which may or may not be termination portions of the entire wall.

The concrete columns are coupled to underground concrete support structures, the combination of which form part of the foundation of the building. The below ground concrete support structures extend below the base construction surface (e.g., the ground) to depths which may range from 2-12 meters. The concrete support structures are typically formed by first drilling or digging a hole in the ground reaching the desired depth, placing iron rods into the base of the hole which extend upward out of the hole and slightly above the ground, and then pouring a cement based mixture to fill the hole. This leaves the iron rods fixedly positioned in the ground and partially extending above the ground, to heights dictated by the height of the building, which may be in the range of 4-10 meters. The concrete columns are formed by pouring a cement based mixture into a hollow sleeve centered about the exposed portion of the iron rods and removably fastened to the base construction surface. As such, when the concrete columns set, the formerly exposed portions of the iron rods are encased within the set concrete. The hollow sleeve may be of any geometric configuration, most typically square, rectangular, or L-shaped, and is constructed from wood panels or tin.

Referring now to the drawings, FIG. 1 shows a top view illustrating a non-limiting example deployment of a construction assembly, generally designated 10, used for sequentially laying blocks. In the non-limiting example deployment of the construction assembly 10 illustrated in FIG. 1, the components of the construction assembly 10 are used to define the perimeter of the structure for which external walls are to be built. Although not illustrated in the drawings, similar components of the construction assembly 10 are used to define internal walls of the structure as well.

Generally speaking, construction assembly 10 includes a series of frame modules and elongated connector beams which are aligned to define the walls of the structure. The frame modules encase, at least partially, the contours of concrete columns. Within the context of this document, the contour of a concrete column includes the peripheral surfaces of a fully set and formed concrete column, as well as to a sleeve into which concrete is poured to form a concrete column. As mentioned above, the sleeve of a concrete column is a generally hollow structure that defines the shape of the concrete column. In this way, the construction assembly 10 of the present disclosure can be deployed in construction sites in which none of the above ground concrete columns have been formed, as well as construction sites in which some or all of the above ground concrete columns have been formed.

The frame modules include two types of frame modules, namely straight frame modules 12 and L-frame modules 30. The frame modules 12, 30 are deployed to at least partially encase respective contours of concrete columns, and to support series of pairs of parallel connector beams 62, 70, between which rows and layers of blocks 80 are positioned. Each of the frame modules 12, 30 includes a pair of frame members, each being of approximately the same height as the height of the contours of the concrete columns which they encase, and preferably constructed from a strong and durable metallic material, most preferably iron. The straight frame modules 12 are deployed to encase concrete columns positioned between corners of a wall. The L-frame modules 30 are deployed to encase corner concrete columns of a wall.

When deployed, the frame members of each frame module are spaced apart by a perpendicular distance approximately equal to the depth of the blocks from which the wall is constructed.

With continued reference to FIG. 1, refer now to FIGS. 2 and 3, a straight frame module 12. The straight frame module 12 includes a pair of frame members, namely a first frame member 14 and a second frame member 16. The frame members 14, 16 are effectively identical in structure and operation. Therefore, the structure and operation of the frame members 14, 16 will be described with reference to the first frame member 14 only, and the structure and operation of the frame member 16 will be understood by analogy thereto unless expressly stated otherwise.

The first frame member 14 is defined by two identical parallel elongated side bars 18 and multiple cross bars 20 laterally extending between, and interconnecting, the side bars 18. The cross bars 20 are preferably evenly spaced along the height of the side bars 18, with one of the cross bars 20 positioned at the top of the side bars 18 and another of the cross bars 20 positioned at the bottom of the side bars 18, forming a generally rectangular frame structure. The first frame member 14 may be forged from a single body, or the side bars 18 and the cross bars 20 may be joined together, by welding techniques or the like, for forming the first frame member 14. The frame member 14 may be constructed to have only two cross bars 20 (at the top and bottom of the side bars 18), however, the additional centrally positioned cross bars provide structural reinforcement to the first frame member 14.

Figure 6B:
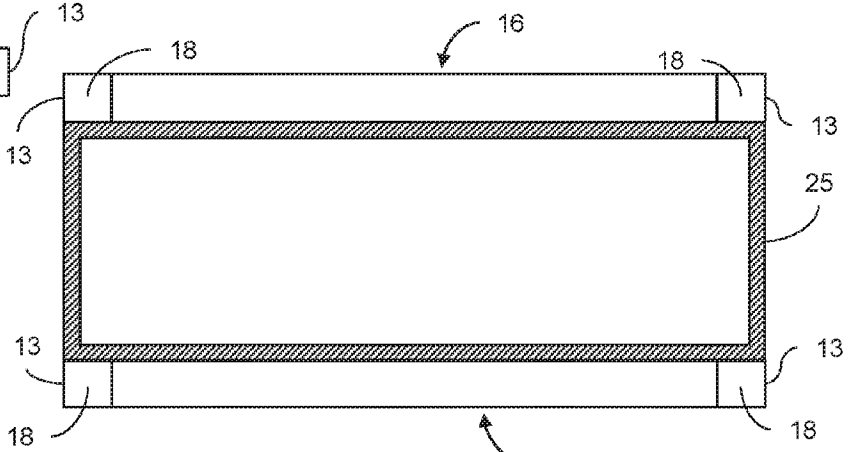
FIGS. 6A and 6B are top views illustrating a schematic representation of the sequential positioning of a pair of frame members to partially encase a rectangular contour of a concrete column, according to the teachings of an embodiment of the present invention
Figure 6A:
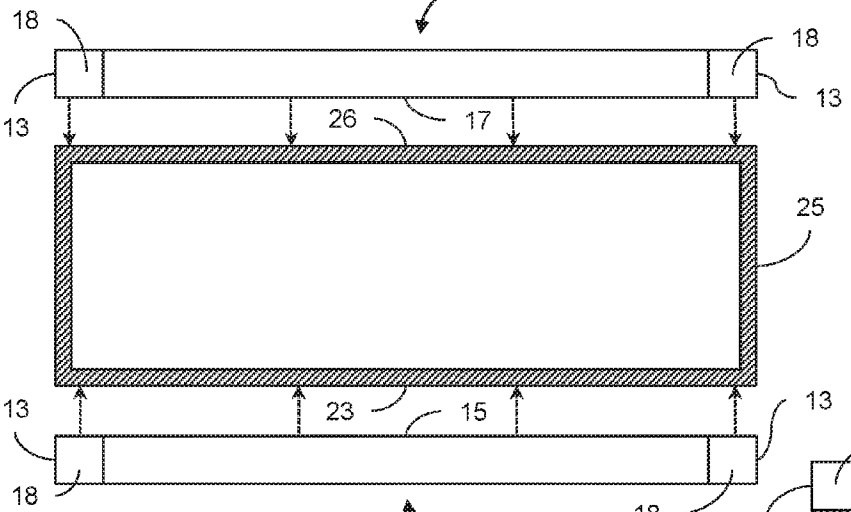

With continued reference to FIGS. 1-3, refer now to FIGS. 6A and 6B, a non-limiting deployment of the straight frame module 12. The straight frame module 12 is deployed to encase, at least partially, a contour 25 of a concrete column that is positioned between edge (i.e., corner) concrete columns of a wall. As shown in the non-limiting example of FIGS. 6A and 6B, the contour 25 is a hollow sleeve-like structure which may having a rectangular or square void. For clarity of illustration, the thickness of the contour 25 is greatly exaggerated in FIGS. 6A and 6B. Although not shown in the drawings, the exposed portions of the iron rods are surrounded by the contour 25.

To facilitate deployment, each of the frame members 14, 16 includes a surface for contacting a portion of the contour 25. The first frame member 14 includes a surface 15, common to the side bars 18 and the cross bars 20, a portion of which contacts a first surface 23 of the contour 25. Similarly, the second frame member 16 includes a surface 17, common to the side bars 18 and the cross bars 20, a portion of which contacts a second surface 26 of the contour 25. The surfaces 23, 26 are oppositely disposed from each other and are approximately perpendicular to the base construction surface (e.g., the ground).

The frame members 14, 16 are placed in contact with corresponding surfaces of the contour 25, such that corresponding contact surfaces of the first frame member 14 and the contour 25 are in the same plane, corresponding contact surfaces of the second frame member 16 and the contour 25 are in the same plane. Subsequent to placement of the frame members 14, 16 in contact with respective surfaces of the contour 25, the frame members 14, 16 are attached to each other, via an attachment mechanism, as will be described in further detail below.

Referring again to FIG. 1, refer now to FIGS. 4 and 5, an L-frame module 30. The L-frame module 30 includes a pair of L-frame members, namely a first L-frame member 32 and a second L-frame member 36. The L-frame members 32, 36 are effectively identical in structure and operation. Therefore, the structure and operation of the L-frame members 32, 36 will be described with reference to the first L-frame member 32 only, and the structure and operation of the L-frame member 36 will be understood by analogy thereto unless expressly stated otherwise. One feature which distinguishes the two L-frame members 32, 36 from each other is the difference in size between the L-frame members 32, 36, with the first L-frame member 32 being smaller than the second L-frame member 36.

The first L-frame member 32 is defined by two axially joined segments, namely a first segment 34*a* and a second segment 34*b*. The two segments 34*a*, 34*b* are joined by an elongated axial bar 42. The first segment 34*a* includes the axial bar 42, an elongated side bar 40*a*, and multiple cross bars 48*a* laterally extending between, and interconnecting, the axial bar 42 and the side bar 40*a*. The second segment 34*b* includes the axial bar 42, an elongated side bar 40*b*, and multiple cross bars 48*b* laterally extending between, and interconnecting, the axial bar 42 and the side bar 40*b*. The shared axial bar 42 forms a joint, which may be fixed, at which the two segments 34*a*, 34*b* are perpendicular to each other, giving the second L-frame member 32 its general L-shape. Alternatively, the axial connection between the two segments 34*a*, 34*b* may be implemented via a hinge-like mechanism, allowing the two segments 34*a*, 34*b* to rotate about the longitudinal axis of the axial bar 42, providing an adjustable angle between the two segments 34*a*, 34*b*.

The second L-frame member 36 is defined by two axial joined segments, namely a first segment 38*a* and a second segment 38*b*. The two segments 38*a*, 38*b* are joined by an elongated axial bar 46. The first segment 38*a* includes the axial bar 46, an elongated side bar 44*a*, and multiple cross bars 49*a* laterally extending between, and interconnecting, the axial bar 46 and the side bar 44*a*. The second segment 38*b* includes the axial bar 46, an elongated side bar 44*b*, and multiple cross bars 49*b* laterally extending between, and interconnecting, the axial bar 46 and the side bar 44*b*. The shared axial bar 46 forms a joint, which may be fixed, at which the two segments 38*a*, 38*b* are perpendicular to each other, giving the second L-frame member 32 its general L-shape. Alternatively, the axial connection between the two segments 38*a*, 38*b* may be implemented via a hinge-like mechanism, allowing the two segments 38*a*, 38*b* to rotate about the longitudinal axis of the axial bar 46, providing an adjustable angle between the two segments 38*a*, 38*b*.

When deployed, the first segment 34*a* of the first L-frame member 32 is parallel to the first segment 38*a* of the second L-frame member 36, and the second segment 34*b* of the first L-frame member 32 is parallel to the second segment 38*b* of the second L-frame member 36.

Note that the description herein of the structure of the cross bars 48*a*, 48*b*, 49*a*, 49*b* is generally similar to that of the cross bars 20, and will be understood by analogy thereto.

Figure 7B:
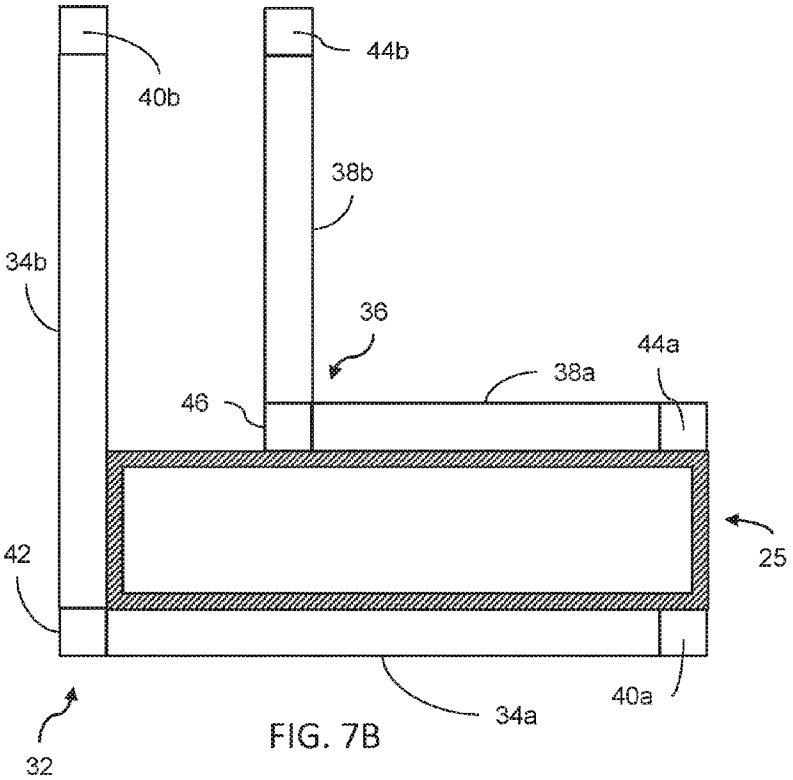
FIGS. 7A and 7B are top views illustrating a schematic representation of the sequential positioning of a pair of frame members of an L-frame to partially encase a rectangular contour of a concrete column, according to the teachings of an embodiment of the present invention.
Figure 7A:
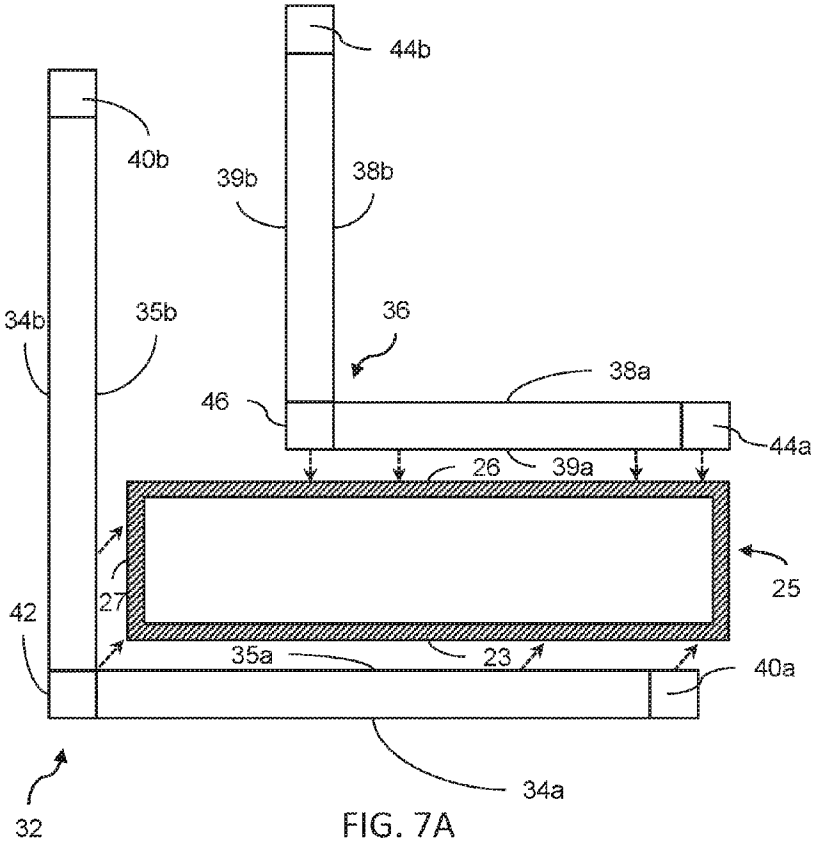

With continued reference to FIGS. 1, 4 and 5, refer now to FIGS. 7A and 7B, a non-limiting the deployment of the L-frame module 30. The L-frame module 30 are deployed to encase a contour 25 of a corner concrete column of a wall. The deployment of the L-frame module 30 is generally similar to that of the deployment of the straight frame module 12, discussed above.

To facilitate deployment, each of the segments of the L-frame members 32, 36 includes a surface for contacting a portion of the contour 25. As discussed above, the contour 25 is a hollow sleeve-like structure having a rectangular or square void. The first segment 38*a* of the second L-frame member 36 includes a surface 39*a*, common to the axial bar 46, the side bar 44*a* and the cross bars 49*a*, for contacting a surface of the contour 25. Similarly, the first segment 34*a* of the first L-frame member 32 includes a surface 35*a*, common to the axial bar 42, the side bar 40*a* and the cross bars 48*a*, for contacting a surface of the contour 25. Similarly, the second segment 38*b* of the second L-frame member 36 includes a surface 39*b*, common to the axial bar 46, the side bar 44*b* and the cross bars 49*b*, for contacting a surface of the contour 25. Similarly, the second segment 34*b* of the first L-frame member 32 includes a surface 35*b*, common to the axial bar 42, the side bar 40*b* and the cross bars 48*b*, for contacting a surface of the contour 25.

The frame members 32, 36 are placed in contact with corresponding surfaces of the contour 25, such that corresponding contact surfaces of the first L-frame member 32 and the contour 25 are in the same plane, corresponding contact surfaces of the second L-frame member 36 and the contour 25 are in the same plane. When deployed, the distance between the surface 35*a* and the surface 39*a* is approximately equal to the distance between the surface 34*b* and the surface 39*b*, which is approximately equal to the depth of the block used to construct the block-based wall.

In the non-limiting deployment illustrated in FIGS. 7A and 7B, the surface 35*a* contacts the first surface 23 of the contour 25, the surface 39*a* contacts a portion of the second surface 26 of the contour 25, and a portion of the surface 35*b* contacts a third surface 27 of the contour 25. The third surface 27 is perpendicular to the surfaces 23, 26. Note that depending on the orientation of the contour 25, the contact surfaces of the L-frame module 30 may change. For example, if the contour 25 as depicted in FIGS. 7A and 7B were rotated ninety degrees counter clockwise, the surface 39*b* would contact a portion of the first surface 23 of the contour 25, the surface 35*b* would contact the second surface 26 of the contour 25, and a portion of the surface 35*a* would contact the third surface 27 of the contour 25.

Figure 8B:
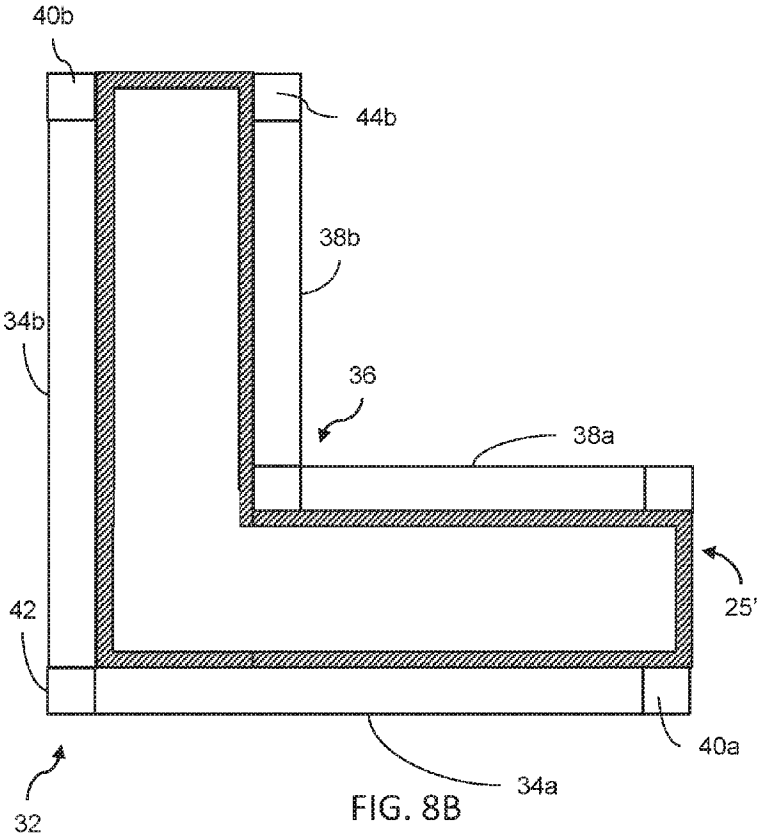
FIGS. 8A and 8B are top views illustrating a schematic representation of the sequential positioning of a pair of frame members of an L-frame to partially encase an L-shaped contour of a concrete column, according to the teachings of an embodiment of the present invention.
Figure 8A:
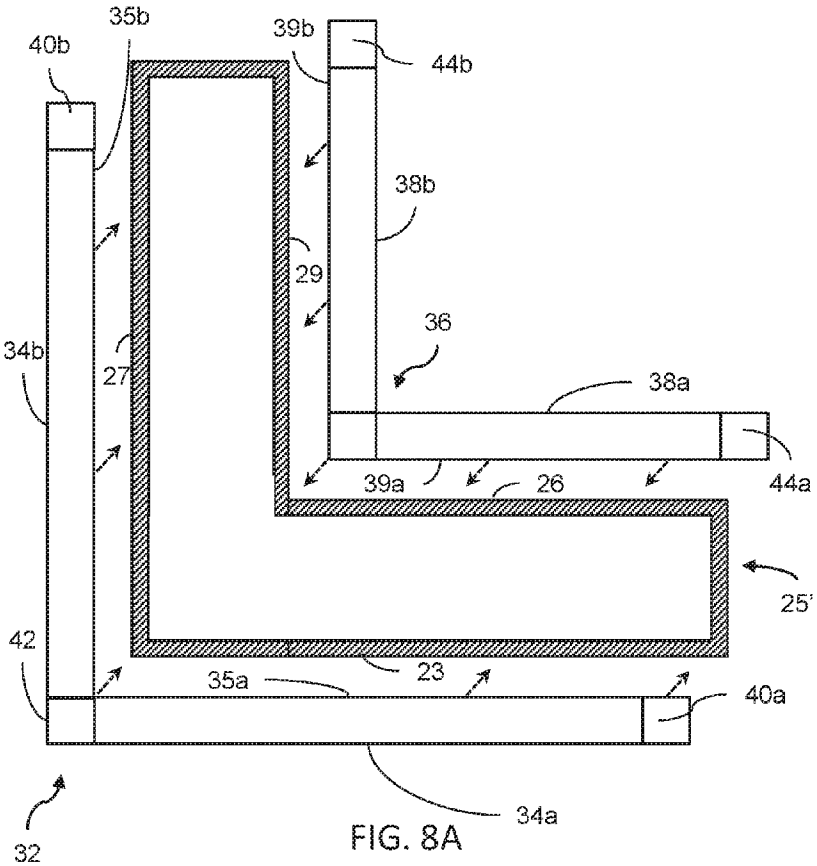

As mentioned above, the L-frame modules 30 are deployed to encase corner concrete columns of a wall, and the sleeve may be generally L-shaped. Accordingly, the concrete column encased by the L-frame modules 30 may be have a generally L-shaped projection onto the base construction surface. FIGS. 8A and 8B illustrate an alternative non-limiting deployment of the L-frame module 30 to encase an L-shaped contour 25', in which the corner angle is 90 degrees. The contour 25' includes the same surfaces as the contour 25 described above with reference to FIGS. 6A-7B, and additionally includes a fourth surface 29 that is that is perpendicular to the surfaces 23, 26 and parallel to the third surface 27. As such, the surface 35*a* contacts the first surface 23 of the contour 25', the surface 39*a* contacts the second surface 26 of the contour 25', the surface 35*b* contacts the third surface 27 of the contour 25', and the surface 39*b* contacts the fourth surface 29.

As mentioned above, the L-frame module 30 may be implemented with an adjustable angle between the two segments for each of the frame members 32, 36. As such, the frame module 30 can be deployed to encase corner concrete columns of a wall in which with corner angle is greater than or less than 90 degrees. As should be apparent, such non-90-degree corner angles result in a different parallel and perpendicular relationship between the surfaces of the contour. Specifically, while the surfaces 23, 26 remain parallel to each other, and the surfaces 27, 29 remain parallel to each other, the surfaces 23, 26 are no longer perpendicular to the surfaces 27, 29.

For clarity of illustration, many of the remaining sections of the present disclosure will describe the structure and operation of the construction assembly 10 within the context of laying blocks between two concrete columns encased by two separate straight frame modules 12. As should be apparent to one skilled in the art, similar techniques may be applied to situations in which a wall is built between a concrete column encased by a straight frame module 12 and a concrete column encased by an L-frame module 30, or to a wall built between two concrete columns encased by two separate L-frame modules 30.

Refer now to FIGS. 9-12, a fastening and tightening mechanism 94 for facilitating the attachment of the frame members 14, 16 to each other, and for adjusting the spacing between the frame members 14, 16. The fastening and tightening mechanism 94 is preferably deployed prior to the pouring of the cement based mixture into the sleeve which forms a concrete column. The fastening and tightening mechanism 94 includes an elongated base portion 96 that is of a height approximately equal to the height of the straight frame module 12, and is of a width approximately equal to the width of the straight frame module 12.

The fastening and tightening mechanism 94 further includes multiple protruding portions 98. The protruding portions 98 are spaced and dimensioned to fit in the spaces between adjacent cross bars 20. In addition, the spaces between the protruding portions 98 are dimensioned to receive the cross bars 20 therein. The dimensions of the protruding portions 98, and the spaces therebetween, facilitate a snap fit resulting in cooperative flush contact between the fastening and tightening mechanism 94 and the corresponding frame member 14, 16. The snap fit actively maintains the cooperative flush contact between the fastening and tightening mechanism 94 and the corresponding frame member 14, 16. The fastening and tightening mechanism 94 is preferably constructed from a strong and durable metallic material, most preferably iron.

Figure 12:
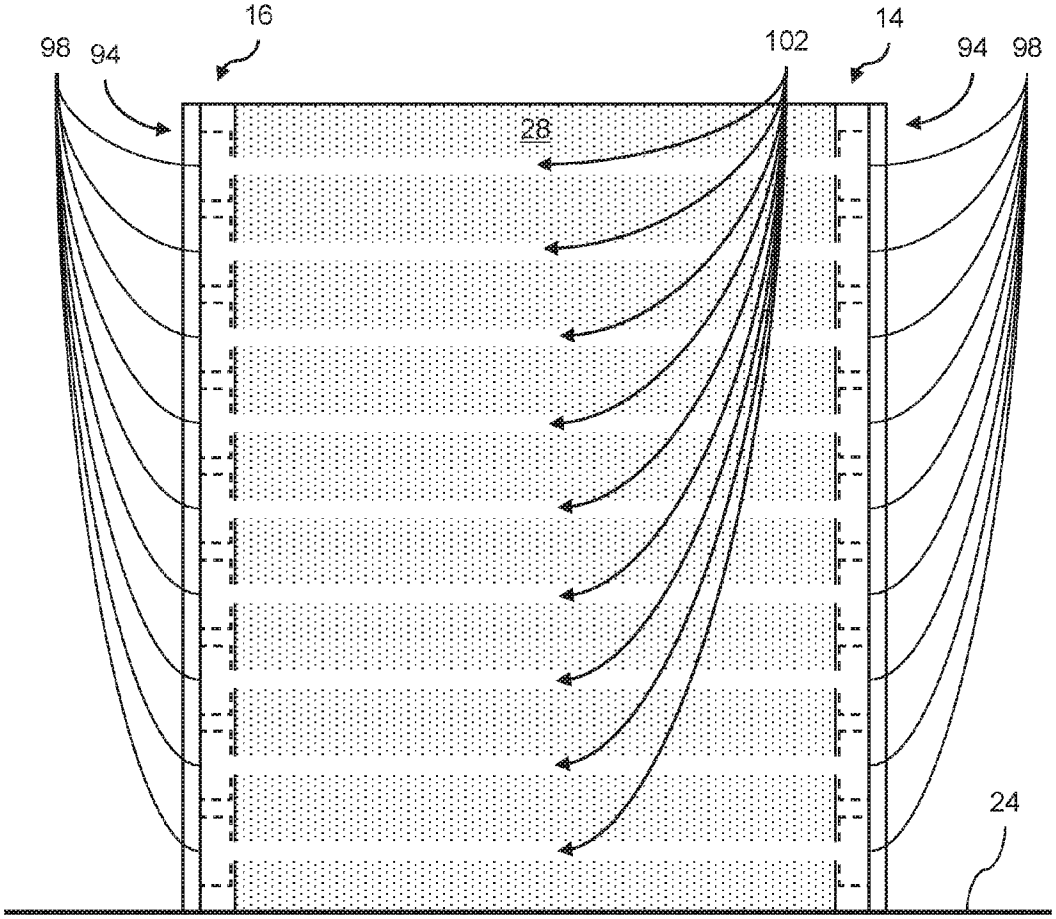
FIG. 12 is a side view illustrating a schematic representation of a concrete column partially encased by a pair of frame members, with a pair of frame module fastening and tightening mechanisms for adjusting the spacing between the frame members of the frame module, according to the teachings of an embodiment of the present invention.

As shown in FIG. 12, each one of the frame members 14, 16 receives a respective fastening and tightening mechanism 94, with respective pairs of protruding portions 98 (shown in phantom) from each of the fastening and tightening mechanisms 94 being aligned at different heights.

Figure 11:
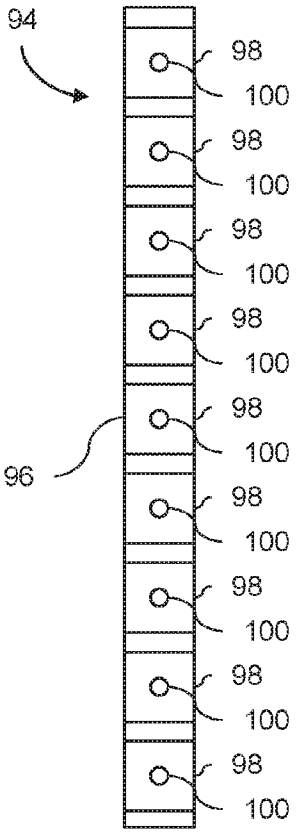
FIGS. 10 and 11 are front and rear views, respectively, corresponding to FIG. 9, according to the teachings of an embodiment of the present invention.
Figure 10:
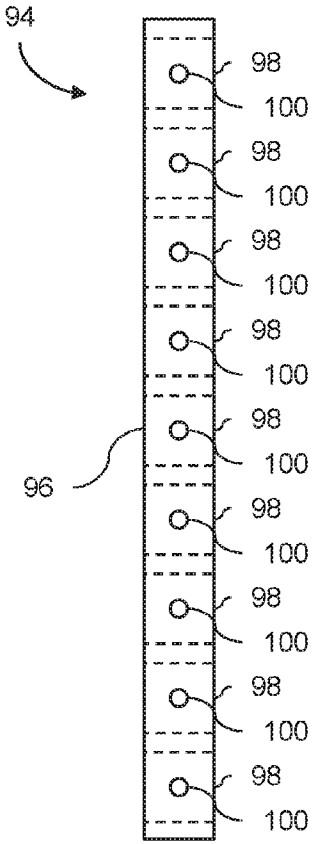
Figure 9:
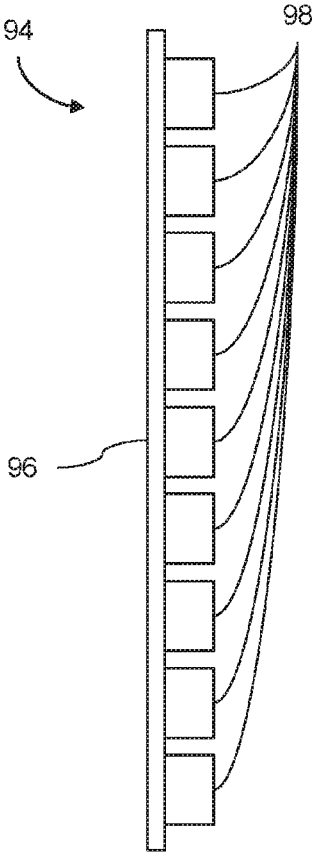
FIG. 9 is a side view illustrating a schematic representation of a frame module fastening and tightening mechanism for adjusting the spacing between the frame members of the frame module, according to the teachings of an embodiment of the present invention.

As shown in FIGS. 10 and 11, each protruding portion 98 has a hole 100, positioned approximately in the center of the protruding portion 98. As such, the fastening and tightening mechanism 94 includes a series of holes 100 evenly spaced along the height of the fastening and tightening mechanism 94. When each of the frame members 14, 16 has a respective fastening and tightening mechanism 94 attached thereto and the straight frame module 12 is deployed to encase the contour 25, a sequence of holes is created in the contour 25 (i.e., the sleeve). Each hole in the sleeve is created, for example, by aligning a drill bit with a respective one of the holes 100, and puncturing the surface of the sleeve nearest the respective hole 100, to form a hole in the sleeve that is aligned with the respective hole 100. This process may be repeated until each hole 100 has a corresponding adjacent hole in the sleeve.

As a result of the symmetry of the frame members 14, 16, and the symmetric deployment of the straight frame module 12, each hole in the sleeve is aligned with another hole in the sleeve, as well one of the holes 100 from the fastening and tightening mechanism 94 coupled to the first frame member 14, and one of the holes 100 from the fastening and tightening mechanism 94 coupled to the second frame member 16. As such, a series of four aligned holes are positioned at evenly spaced intervals along the height of the contour 25 (two holes in the sleeve and two holes in the fastening and tightening mechanisms 94).

Subsequently for each series of four holes, a pipe, made from, for example, polyvinyl chloride (PVC), may be threaded through the four-hole series. A bolt may then be threaded through the pipe, and fastened with a bolt, thereby attaching the frame members 14, 16 to each other, with the contour 25 encased between the frame members 14, 16. Subsequently, the cement based mixture is poured into the sleeve to form the concrete column, leaving hollow portions formed by the PVC pipes, each hollow section being aligned with a respective one of the holes 100 of the fastening and tightening mechanism 94.

FIG. 12 depicts a non-limiting example showing a formed concrete column 28 positioned between the frame members 14, 16, each of which having a fastening and tightening mechanism 94 coupled thereto. Multiple hollow sections 102, extending through the formed concrete column 28, and laterally between frame members 14, 16, are the results of hollow sections of PVC pipe. The formed concrete column 28 extends perpendicular to the ground 24, which acts as the base construction surface in this non-limiting example. As should be apparent, the straight frame module 12 is deployed perpendicular to the ground 24 as well.

For the contour of each concrete column of the structure being built, an appropriate frame module (straight frame module 12 or L-frame module 30) is deployed to encase the contour, with a corresponding fastening and tightening mechanism 94 coupled to the frame members of the frame module. When applied to the L-frame modules 30, the fastening and tightening mechanisms 94 may be dimensioned according to the height and width of the L-frame module 30, and may be coupled to each of the first segment 34*a*, the second segment 34*b*, the first segment 38*a*, and the second segment 38*b*, thereby coupling the first segments 34*a*, 38*a* to each other and coupling the second segments 34*b*, 38*b* to each other.

Note that the frame modules 12, 30 may be deployed after the concrete column is formed. In such a deployment, the fastening and tightening mechanisms 94 may be coupled to the appropriate frame members, and the frame members 14, 16 (or the frame members 32, 36) may be fastened to each other via a fastening mechanism, such as, for example, rope, cabling, or cable ties (commonly referred to as zip ties). Holes may then be drilled through the concrete column, at positions which align with the respective holes 100 of the fastening and tightening mechanisms 94, to achieve the hollow section and hole alignment illustrated in FIG. 12. Alternatively, the rope, cabling, or zip ties may be used to maintain the attachment of the frame members of a frame module (either straight frame modules 12 or L-frame modules 30) to each other. However, such attachment may yield a less stable attachment, resulting in misalignment of adjacent frame modules 12, 30. Alternatively, the frame members of a frame module may be attached to each other, through the contour, via hardware fasteners (e.g., screws, nails, heavy metal staples, etc.) extending through holes in the cross bars 20, 48*a*, 48*b*, 49*a*, 49*b*.

As noted above, each of the frame modules 12, 30 supports a series of pairs of connector beams 62, 70, used for laying blocks in stacked aligned rows. Each of the frame members of the frame modules includes an attachment mechanism for facilitating the attachment of the connector beams 62, 70 to the frame members.

Figure 13:
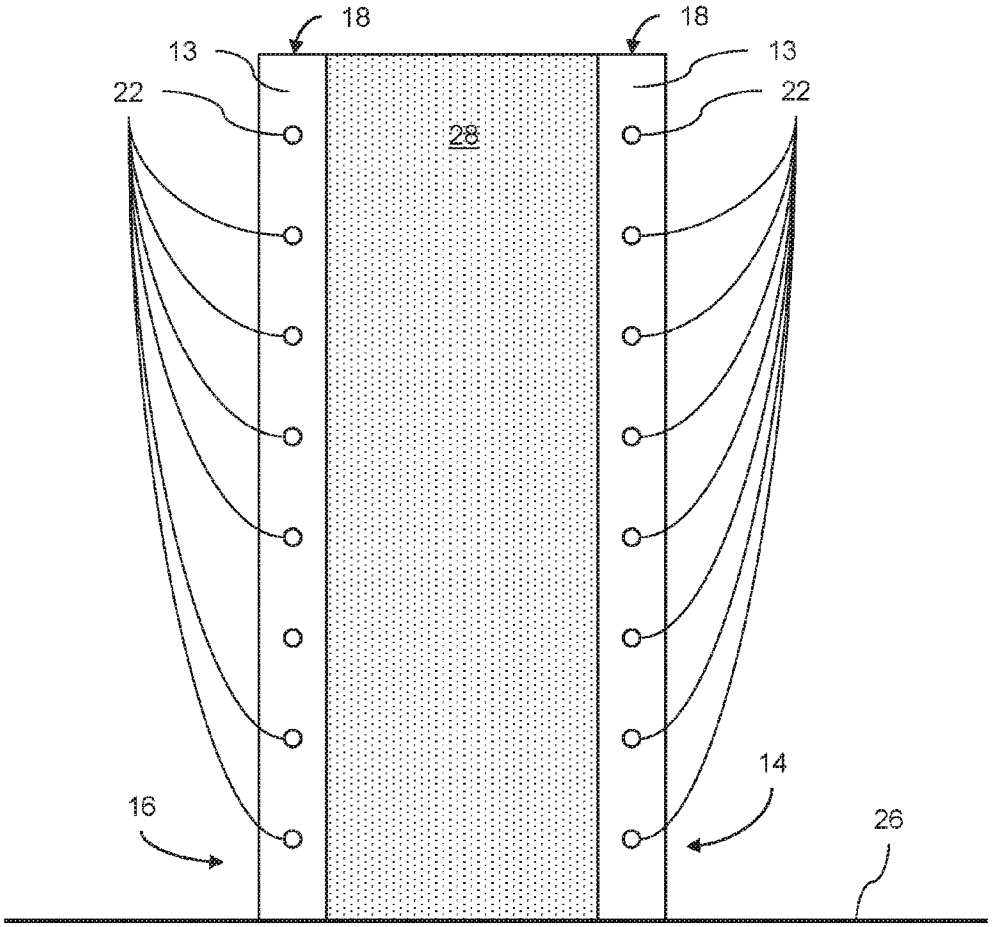
FIG. 13 is a side view illustrating a schematic representation of a concrete column partially encased by a pair of frame members, according to the teachings of an embodiment of the present invention.
Figure 15:
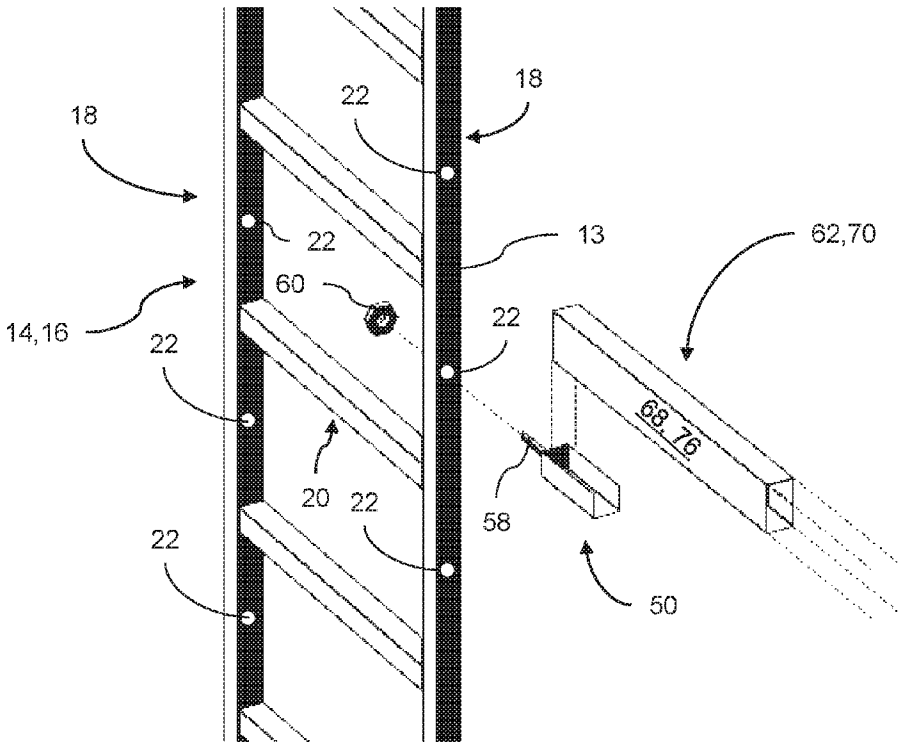
FIG. 15 is an isometric exploded view illustrating a frame member with a single attachment mechanism for coupling a connector beam to the frame member, according to the teachings of an embodiment of the present invention.
Figure 14:
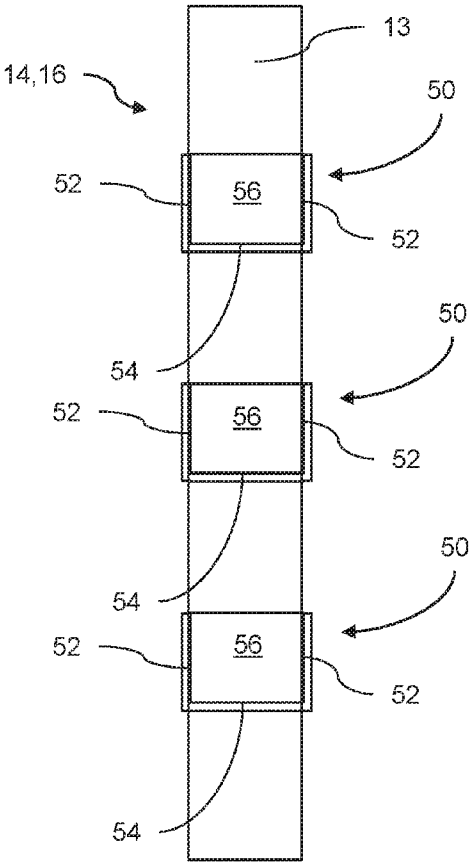
FIG. 14 is a side view illustrating a schematic representation of multiple attachment mechanisms coupled to a frame member, according to the teachings of an embodiment of the present invention.

With continued reference to FIGS. 1-12, refer now to FIGS. 13-15, an attachment mechanism 50 for attaching a connector beam 62, 70 to a frame member. The attachment mechanism 50 includes two parallel sidewalls 52 joined by a bottom wall 54 that supports the connector beam 62, 70. A back wall 56, perpendicular to both the sidewalls 52 and the bottom wall 54, is attached to the sidewalls 52 and the bottom wall 54, leaving a rectangular block shaped void in the space between the sidewalls 52, the bottom wall 54 and the back wall 56. A connector 58, such as a threaded bolt, is perpendicularly connected to an outer surface of the back wall 56, and extends outwardly away from the rectangular block shaped void of the attachment mechanism 50. The connector 58 is configured to be threaded through a hole 22 positioned in the frame member 14, 16.

As shown in FIG. 13, each of the frame members 14, 16 includes a series of holes 22, evenly spaced along the height of the frame members 14, 16. The holes 22 are aligned along (i.e., centered about) the longitudinal axis of the respective side bar 18, and positioned in a surface 13 of the respective side bar 18 that is perpendicular to the base construction surface (i.e., ground) and perpendicular to the surface 15, 17 for contacting the contour 25, as described above. Accordingly, the attachment mechanism 50 is aligned along (i.e., centered about) the longitudinal axis of the respective side bar 18, and can be placed at various elevations along the height of the frame module 12. Each attachment mechanism 50 is held in place along the side bar 18 by a corresponding fastener 60, for example a nut, that is threaded onto the connector 58.

Although not shown in the drawings, a series of similar holes are positioned along a respective side surface of the side bars 40*a*, 40*b*, 44*a*, 44*b*, and evenly spaced along the height of the frame members 32, 36. As should be apparent, the side surface along which the holes are positioned for the side bar 40*a* is the surface of the side bar 40*a* that is perpendicular to the surface 35*a* and the base construction surface (i.e., ground), and is parallel to the surface 35*b*. Similarly, the side surface along which the holes are positioned for the side bar 40*b* is the surface of the side bar 40*b* that is perpendicular to the surface 35*b* and the base construction surface (i.e., ground), and is parallel to the surface 35*a*. Similarly, the side surface along which the holes are positioned for the side bar 44*a* is the surface of the side bar 44*a* that is perpendicular to the surface 39*a* and the base construction surface (i.e., ground), and is parallel to the surface 39*b*. Similarly, the side surface along which the holes are positioned for the side bar 44*b* is the surface of the side bar 44*b* that is perpendicular to the surface 39*b* and the base construction surface (i.e., ground), and is parallel to the surface 39*a*.

As shown in FIG. 14, the width of the attachment mechanism 50, defined by the distance between the sidewalls 52, is preferably slightly larger than the width of the side surface 13 of the side bar 18 (and the corresponding side surfaces of the side bars 40*a*, 40*b*, 44*a*, 44*b*) to which the attachment mechanism 50 is attached. As will be described in further detailed below, the preferred width of the attachment mechanism 50 ensures flush alignment of the connector beam 62, 70 with the appropriate frame member of the appropriate frame module.

Each of the frame members 14, 16, 32, 36 is constructed to receive an appropriate connector beam. The connector beams 62, 70 are identical in structure and operation and are interchangeable. The connector beams 62, 70 are preferably constructed from a metallic material, such as, for example, aluminum or steel. The connector beams 62, 70 are preferably implemented as elongated rectangular or square cuboids.

For clarity of illustration of the operation of the construction assembly 10, the connector beam 62 is received by, and attached to, the frame members 14, 32, and the connector beam 62 is received by, and attached to, the frame members 16, 36. As should be apparent to one skilled in the art, since the connector beams 62, 70 are interchangeable, the positioning of the connector beams 62, 70 may be swapped with each other.

In operation, for each row of blocks to be laid to form a wall, a first connector beam is attached to the first frame members of two different frame modules, and a second connector beam is attached to the second frame members of the same two different frame modules. As should be apparent, the vertical spacing between the longitudinal axis of each the connector beams are dictated by the vertical spacing between the attachment mechanisms 50, and thus the vertical spacing between the holes 22 in the frame members.

The choice for the amount of vertical spacing between the longitudinal axis of adjacent connector beams is preferably based on the dimensions of the blocks to be laid, and the thickness (i.e., along the axis perpendicular to the base construction surface) of the connector beams. For example, if each row of blocks is positioned against a single respective pair of connector beams, and if the blocks in each row have a height of 20 centimeters (cm), the vertical spacing between the longitudinal axis of adjacent connector beams is preferably 20 cm. Preferably the vertical spacing between the holes 22 is on the order of approximately 5 cm, thereby allowing a wide range of spacing intervals. For example, three connector beams 62 may be attached to the frame members, with vertical spacing between the bottom connector beam and the middle connector beam being 10 cm, and the vertical spacing between the middle connector beam and the top connector beam being 30 cm. This allows rows consisting of blocks of different sizes to be laid in stacks supported by the connector beams.

Construction blocks, such as the block 80 schematically illustrated in FIGS. 24 and 25, are typically available in a variety of depth (D), height (H) and length (L) dimensions, referred to in shorthand as D×H×L. For example, the block 80 may have dimensions such as 20 cm×20 cm×60 cm, 20 cm×20 cm×30 cm, 20 cm×20 cm×45 cm, 10 cm×10 cm×60 cm, 10 cm×10 cm×30 cm, 10 cm×10 cm×45 cm, or any reasonable combination of D, H and L. In many instances, internal walls are constructed from blocks having depth and height of 10 cm, while external walls are constructed from thicker blocks having depth and height of 20 cm, which provide additional insulation.

Figure 16:
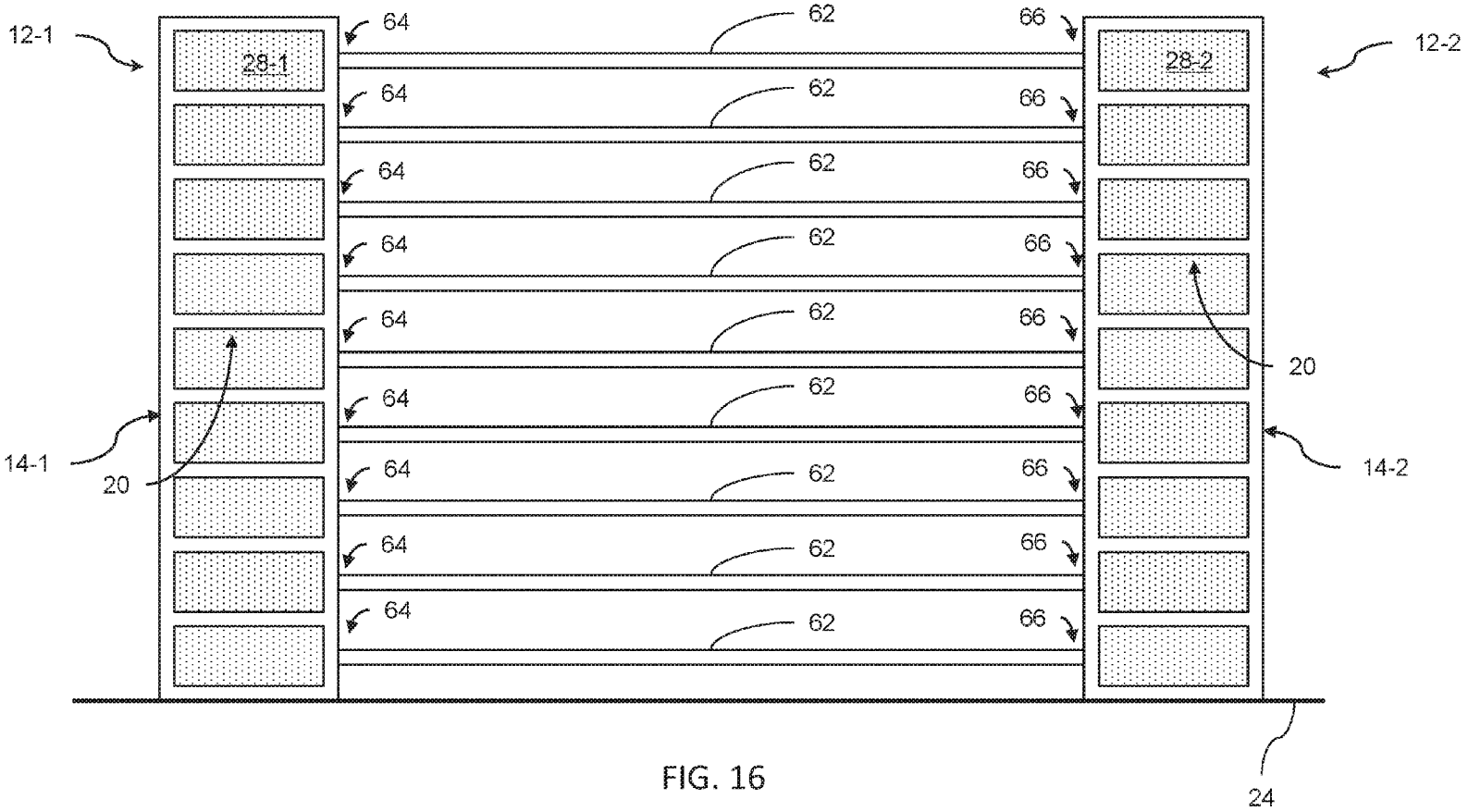
FIG. 16 is a front view illustrating a schematic representation of frame members of two different frame modules having multiple connector beams extending therebetween, according to the teachings of an embodiment of the present invention.

With continued reference to FIGS. 1-15, refer now to FIGS. 16-19, the attachment of connector beams and the sequential laying of blocks to form a wall, or a portion thereof. FIG. 16 depicts the attachment of multiple connector beams 62 to the first frame member of two different frame modules, namely a first frame module 12-1 and a second frame module 12-2. Specifically, each of the connector beams 62 includes a first end 64 that is attached to a first frame member 14-1 of the first frame module 12-1, a second end 66 that is attached to a first frame member 14-2 of the second frame module 12-2, and a planar surface 68, which is extends along the length of the connector beam 62. The planar surface 68 is preferably rectangular and is dimensioned to receive a row of blocks at a direct abutment. The attachment of the connector beams 62 to the first frame members 14-1, 14-2 is made via the attachment mechanism 50, discussed above. Each of the connector beams 62 is dimensioned to slideably fit into the rectangular block shaped void of the corresponding attachment mechanism 50.

Referring now to FIGS. 17A-17E, a first concrete column 28-1 is shown as encased by the attachment of the first frame member 14-1 to a second frame member 16-1, via the fastening and tightening mechanism 94 as discussed above. Similarly, the second concrete column 28-2 is shown as encased by the attachment of the first frame member 14-2 to a second frame member 16-2, via the fastening and tightening mechanism 94 as discussed above. It is noted that the contours of each of the concrete columns 28-1, 28-2 depicted in FIGS. 17A-17E includes respective surfaces 23, 26. As such, the contours of the concrete columns 28-1, 28-2 are spatially positioned such that the surface 23 of the contour of the first concrete column 28-1 and the surface 23 of the contour of the second concrete column 28-2 are coplanar, and the surface 26 of the contour of the first concrete column 28-1 and the surface 26 of the contour of the second concrete column 28-2 are coplanar. As a result, the first members 14-1, 14-2 are aligned with each other (i.e., are coplanar), and the second members 16-1, 16-2 are aligned with each other (i.e., are coplanar).

The resultant attachment of the connector beams 62 to the first frame members 14-1, 14-2 yields vertical spacing between the connector beams 62 along the height of the first frame members 14-1, 14-2, and parallel positioning of the connector beams 62 to each other and to the ground 24. Since each attachment mechanism 50 is aligned along (i.e., centered about) the longitudinal axis of the respective side bar 18 of the first frame members 14-1, 14-2, the planar surface 68 of each of the connector beams 62 are in the same plane. Furthermore, the resultant attachment of the connector beams 62 to the first frame members 14-1, 14-2 yields alignment of the connector beams 62 with the first frame members 14-1, 14-2 along an axis laterally extending between the surface 13 of each of the first frame members 14-1, 14-2.

The slideable fitting of each of the connector beams 62 into the rectangular block shaped void of the corresponding attachment mechanism 50 ensures nearly perfect flush alignment of the connector beams 62 with the first frame members 14-1, 14-2. As such, the planar surface 68 of the connector beam 62 and the surfaces 15, 23 lay in parallel planes which are separated by a small margin. Ideally, the planar surface 68 of the connector beam 62 and the surfaces 15, 23 are coplanar, and the margin can be reduced to achieve such a coplanar result by adjusting the spacing between the first frame member 14-1 and the second frame member 16-1, via adjustment of the corresponding fastening and tightening mechanism 94.

The fastening and tightening mechanism 94 may be adjusted by sequential tightening adjustment of the respective fastening bolts that are threaded through the respective holes 100 at height intervals corresponding to the vertical distance of the connector beam 62 from the base construction surface. For example, if the connector beam 62 is deployed to align a row of blocks closest to the base construction surface (e.g., the blocks 80*a*-1-80*e*-1 in FIG. 18A), the adjustment of the spacing between the first frame member 14-1 and the second frame member 16-1 may be effectuated by tightening adjustment of the fastening bolts threaded through the holes 100 which are nearest to the base construction surface. As a further example, if the connector beam 62 is deployed to align a row of blocks furthest from the base construction surface (e.g., the blocks 80*a*-9-80*e*-9 in FIG. 18D), the adjustment of the spacing between the first frame member 14-1 and the second frame member 16-1 may be effectuated by tightening adjustment of the fastening bolts threaded through the holes 100 which are furthest away from the base construction surface.

With continued reference to FIGS. 17A-17E, the deployment of an Nth row of blocks. The first block in the row is identified as block 80*a*-N. Each of the blocks includes oppositely disposed planar surfaces, specifically a first planar surface 82 and second planar surface 84. These surfaces are schematically illustrated in FIGS. 17A-17D and 25. When implemented as a square or rectangular cuboid, each block further includes oppositely disposed third and fourth planar surfaces 86, 87 (that are square or rectangular) perpendicular to the planar surfaces 82, 84. When laying each block, the planar surfaces 86, 87 are perpendicular to the base construction surface (i.e., the ground) as well.

Figure 17A:
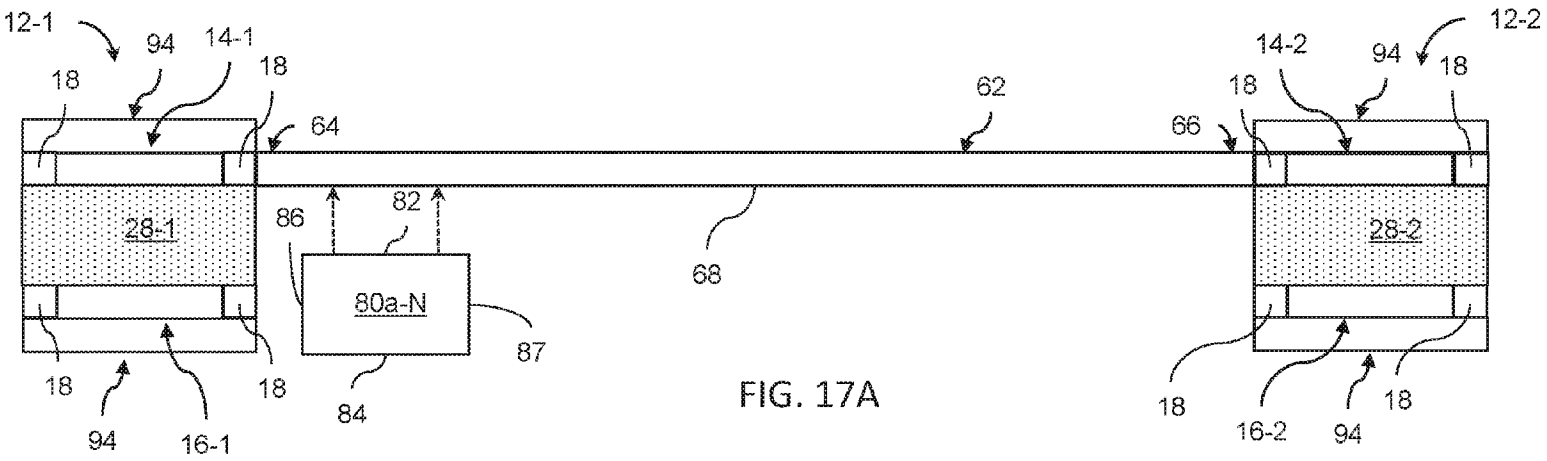
FIGS. 17A-17E are top views illustrating a schematic representation of the sequential deployment of a single row of construction blocks between two frame modules, according to the teachings of an embodiment of the present invention.
Figure 17B:
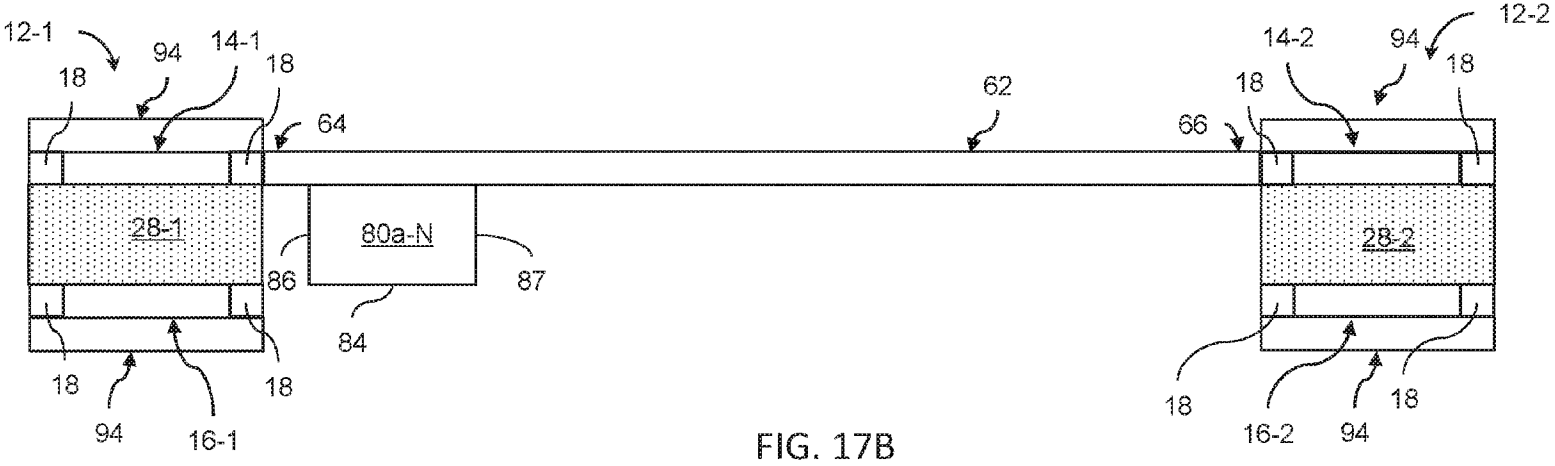

In FIG. 17A, the first block 80*a*-N is positioned away from the connector beam 62, and is positioned away from the first frame module 12-1. In FIG. 17B, the first block 80*a*-N is slid into contact with a corresponding one of the connector beams 62 such that the planar surface 82 of the block 80*a*-N and the planar surface 68 of the connector beam are at a direct abutment. The connector beam 62 with which the block 80*a*-N contacts is deployed at a vertical position along the height of the frame members 14-1, 14-2 corresponding to the height of the block 80*a*-N and the elevated position of the block 80*a*-N.

Figure 17C:
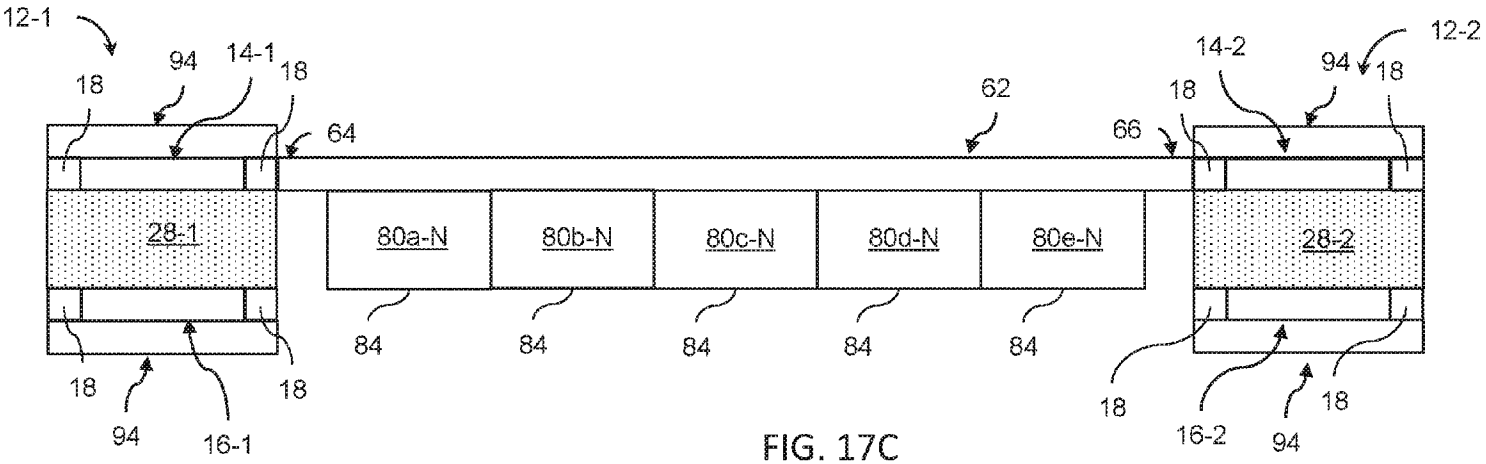

In FIG. 17C, additional blocks 80*b*-N, 80*c*-N, 80*d*-N, 80*e*-N are slid into contact with the same connector beam 62 such that the planar surface 82 of each of the blocks 80*b*-N, 80*c*-N, 80*d*-N, 80*e*-N is at a direct abutment with the planar surface 68 of the connector beam 62. In addition, an adhesive cement based material may be placed on the planar surfaces 86, 87 of the blocks 80*a*-N, 80*b*-N, 80*c*-N, 80*d*-N, 80*e*-N in order to adhere adjacent blocks to each other. The adhesive cement material forms an adhesive connection at a direct abutment between the planar surfaces 86, 87 of adjacent blocks. For example, an adhesive connection is formed at a direct abutment between the third planar surface 86 of the block 80*b*-N and the fourth planar surface 87 of the block 80*a*-N.

Figure 17D:
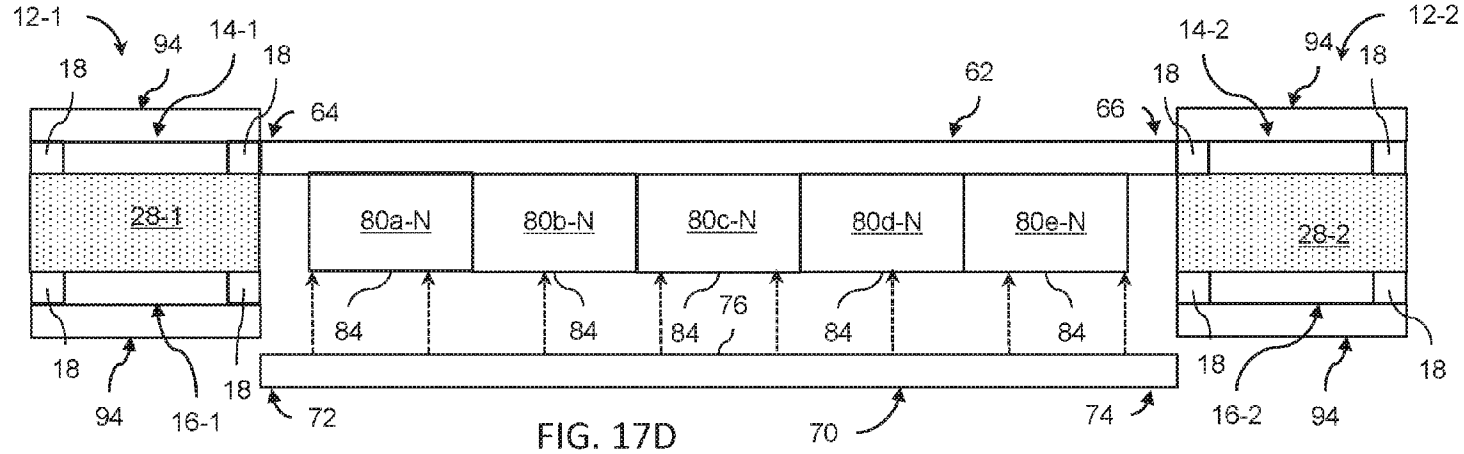

In FIG. 17D, a corresponding one of the connector beams 70 is positioned relative to the Nth row of blocks opposite the connector beam 62, for deployment and attachment to the second frame member 16-1 of the first frame module 12-1, and deployment and attachment to the second frame member 16-2 of the second frame module 12-2.

Similar to the connector beams 62, each of the connector beams 70 includes a first end 72 that is attached to the second frame member 16-1 of the first frame module 12-1, a second end 74 that is attached to the second frame member 16-2 of the second frame module 12-2, and a planar surface 76, which is extends along the length of the connector beam 70. The planar surface 76, similar to the planar surface 68, is preferably rectangular and is dimensioned to receive a row of blocks at a direct abutment. The attachment of the connector beams 70 to the second frame members 16-1, 16-2 is made via the attachment mechanism 50, discussed above. Each of the connector beams 70 is dimensioned to slideably fit into the rectangular block shaped void of the corresponding attachment mechanism 50. Since each attachment mechanism 50 is aligned along (i.e., centered about) the longitudinal axis of the respective side bar 18 of the first frame members 16-1, 16-2, the planar surface 76 of each of the connector beams 70 are in the same plane.

Figure 17E:
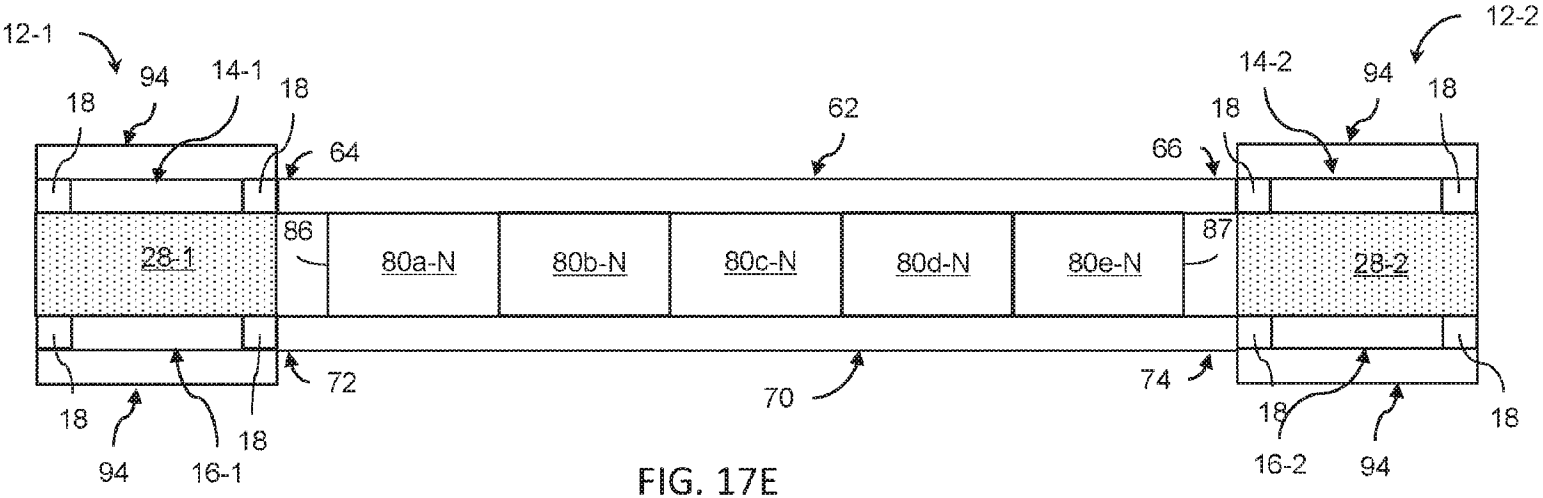

In FIG. 17E, the corresponding one of the connector beams 70 is slid into contact with the blocks 80*a*-N, 80*b*-N, 80*c*-N, 80*d*-N, 80*e*-N such that the planar surface 76 of the connector beam 70 and the planar surface 84 of each of the blocks 80*a*-N, 80*b*-N, 80*c*-N, 80*d*-N, 80*e*-N are at a direct abutment. In addition, the connector beams 62, 70 are parallel to each other when abutting respective surfaces of the blocks 80*a*-N, 80*b*-N, 80*c*-N, 80*d*-N, 80*e*-N.

The resultant attachment of the connector beams 70 to the second frame members 16-1, 16-2 yields vertical spacing between the connector beams 70 along the height of the second frame members 16-1, 16-2, and parallel positioning of the connector beams 70 to each other and to the ground 24. Preferably, the vertical spacing of the connector beams 70 is identical to that of the connector beams 62. Furthermore, the resultant attachment of the connector beams 70 to the second frame members 16-1, 16-2 yields alignment of the connector beams 70 with the second frame members 16-1, 16-2 along an axis laterally extending between the surface 13 of each of the second frame members 16-1, 16-2.

As with the connector beams 62 and the first frame members 14-1, 14-2, the slideable fitting of each of the connector beams 70 into the rectangular block shaped void of the corresponding attachment mechanism 50 ensures nearly perfect flush alignment of the connector beams 70 with the second frame members 16-1, 16-2. As such, the planar surface 76 of the connector beam 70 and the surfaces 17, 26 lay in parallel planes which are separated by a small margin. Ideally, the connector beam 70 and the surfaces 17, 26 are coplanar, and the margin can be reduced to achieve such a coplanar by adjusting the spacing between the first frame member 14-2 and the second frame member 16-2. The spacing between the first frame member 14-2 and the second frame member 16-2 may be adjusted via tightening of the corresponding fastening and tightening mechanism 94, similar to as described above with reference to the connector beam 62.

By adjusting the spacing between the frame members of the first frame module 12-1, and the spacing between the frame members of the second frame module 12-2, the spacing between the connector beams 62, 70 is also adjusted. As a result, the pair of connector beams 62, 70 can be pressed towards each other, reducing alignment error of the connector beams 62, 70 with the respective frame members, and thereby ensuring the secure alignment of the corresponding row of blocks with the contours of the concrete columns 28-1, 28-2.

It is noted that the row of blocks 80*a*-N, 80*b*-N, 80*c*-N, 80*d*-N, 80*e*-N, as depicted in FIG. 17E, is not in direct contact with the concrete columns 28-1, 28-2.

Specifically, there is a gap between the planar surface 86 of the first block 80*a*-N and the first concrete column 28-1, as well as a gap between the planar surface 87 of the fifth block 80*e*-N and the second concrete column 28-2. The width of these gaps is typically in the range of 10-50 cm, and is filled by pouring a cement based mixture into the gap, as will be discussed in more detail below.

Note that contrary to the deployment illustrated in FIG. 16, not all of the connector beams 62 necessarily need to be deployed concurrently prior to receiving a corresponding row of blocks. For example, prior to laying the first row of blocks, a first one of the connector beams 62 may be attached to the first members 14-1, 14-1 of the two different frame modules. Subsequently after laying the first row of blocks, a first one of the connector beams 70 may be attached to the second members 16-1, 16-1 of the frame modules. Subsequently, a second one of the connector beams 62 may be attached to the first members 14-1, 14-1 of the frame modules, at a height supporting the vertical spacing requirement dictated by the height of the blocks of the first row. Subsequently after laying the second row of blocks, on top of the first row of blocks, a second one of the connector beams 70 may be attached to the second members 16-1, 16-1 of the frame modules. This process may then be repeated for each subsequent row of blocks.

Figure 18A:
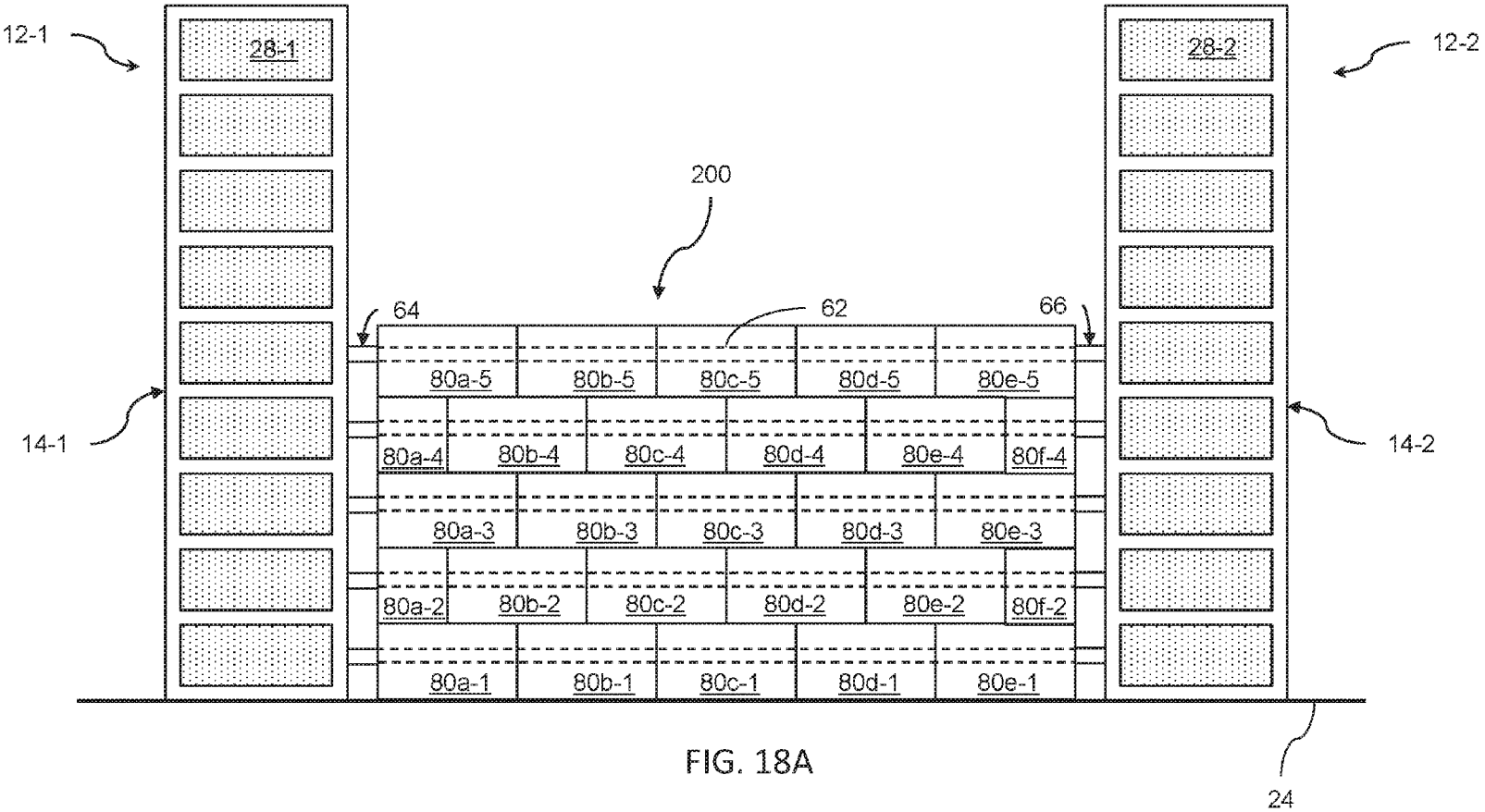
FIGS. 18A-18F are front views illustrating a schematic representation of the sequential deployment and layering of rows of construction blocks between two frame modules, according to the teachings of an embodiment of the present invention.

A more detailed non-limiting construction example of the layering of rows of blocks to construct a wall 200 will now be described with reference to FIGS. 18A-18F. In FIG. 18A, five rows of blocks are deployed, with each row securely aligned with, and extending between, the concrete columns 28-1, 28-2 in accordance with the above description and FIGS. 17A-17E. The first row of blocks includes blocks 80*a*-1, 80*b*-1, 80*c*-1, 80*d*-1, 80*e*-1. The second row of blocks includes blocks 80*a*-2, 80*b*-2, 80*c*-2, 80*d*-2, 80*e*-2, 80*f*-2. Note that the first and last blocks of the second row (blocks 80*a*-2, 80*f*-2) are of approximately half the length of the other blocks in the second row. This reduced block size allows the second row of blocks to be placed at an offset from the first row of blocks, thereby distributing the weight of each full block in the second row onto two blocks in the first row. Similarly, the third row of blocks includes blocks 80*a*-3, 80*b*-3, 80*c*-3, 80*d*-3, 80*e*-3, the fourth row of blocks includes blocks 80*a*-4, 80*b*-4, 80*c*-4, 80*d*-4, 80*e*-4 80*f*-4, and the fifth row of blocks includes blocks 80*a*-5, 80*b*-5, 80*c*-5, 80*d*-5, 80*e*-5. The corresponding connector beams 62, with abutting surfaces obscured by the rows of blocks, are shown in phantom, while the connector beams 70 are not shown.

As is known in the art, a layer of adhesive cement based material is typically placed on a top surface 89 of each block (perpendicular to the surfaces 82, 84, 86, 87, and parallel to the base construction surface, i.e., the ground 24), in order to adhere adjacent rows of blocks to each other.

As mentioned above, gaps are initially present between the rows of blocks and the concrete columns 28-1, 28-2. In order to securely attach the rows of blocks to the concrete columns 28-1, 28-2, a cement based mixture is poured into the gaps and allowed to set. This provides a more secure adhesion of the rows of blocks to the concrete columns 28-1, 28-2 than, for example, cement adhesion used for adhering adjacent blocks to each other.

Figure 18B:
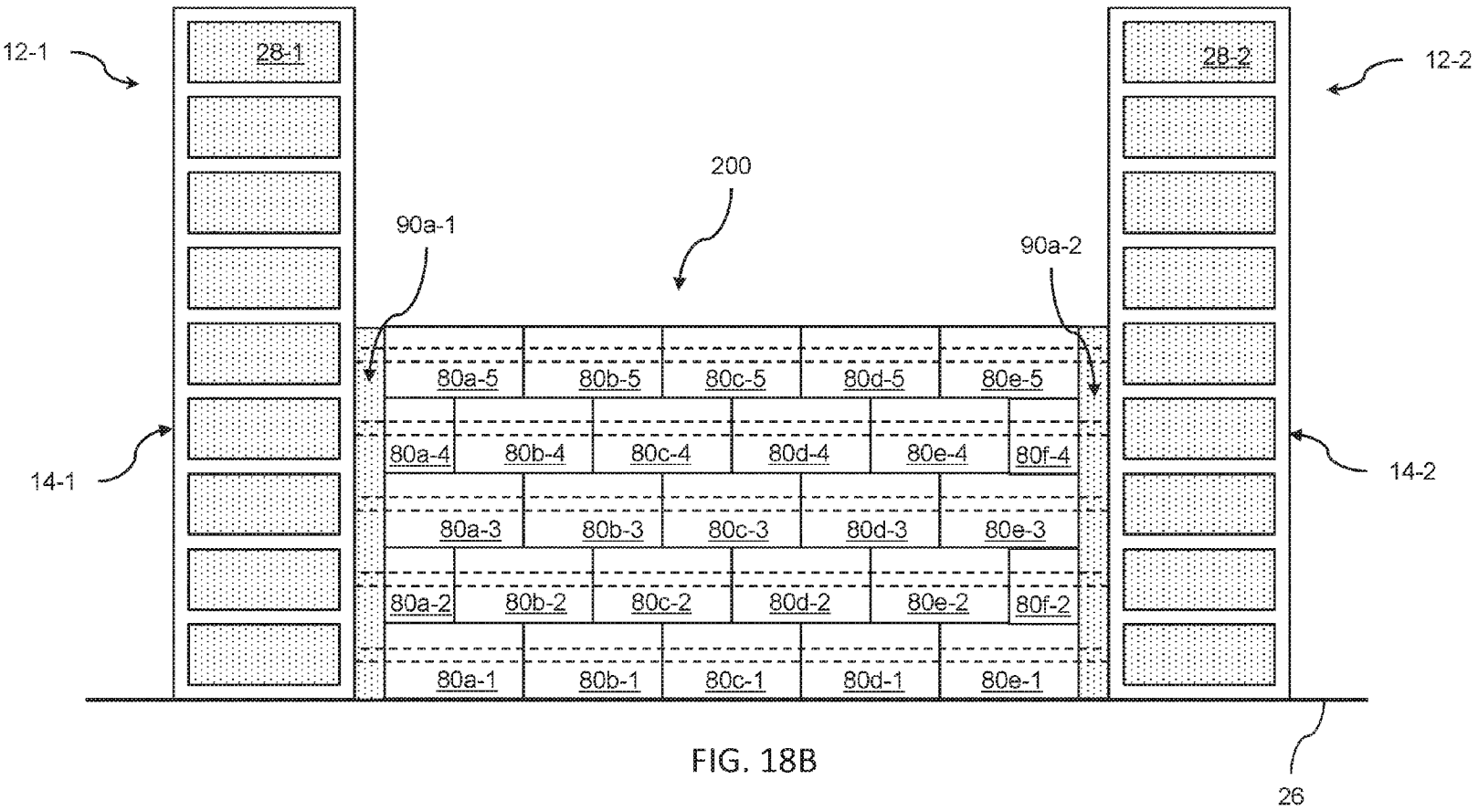

As shown in FIG. 18B, a formed concrete section 90*a*-1 fills the gap that was between the first five rows of blocks and the first concrete column 28-1, thereby securing the first five rows of blocks to the first concrete column 28-1. Similarly, a formed concrete section 90*a*-2 fills the gap that was between the first five rows of blocks and the second concrete column 28-2, thereby securing the first five rows of blocks to the first concrete column 28-2.

Figure 18C:
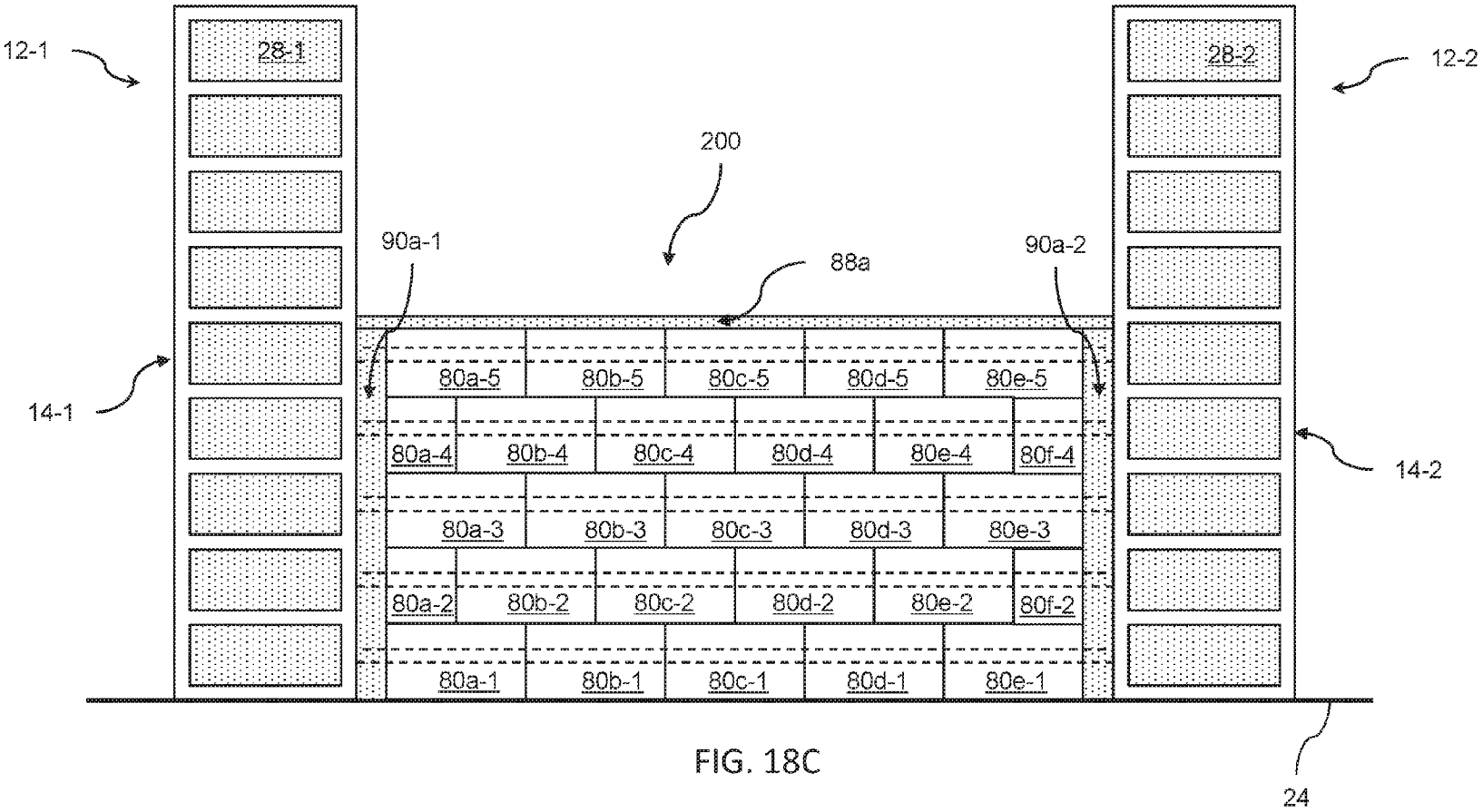

In order to fortify the wall 200 under construction, strips of concrete are typically laid between rows of blocks at specified intervals. The frequency of the intervals is typically based on the architectural and engineering design plans of the structure being built, and may be every 1-2 meters of height of the wall 200 under construction. In the construction example depicted in FIGS. 18A-18F, a first strip of concrete 88*a*, formed from a cement based mixture, is laid on top of the fifth row of blocks, as shown in FIG. 18C.

Figure 18D:
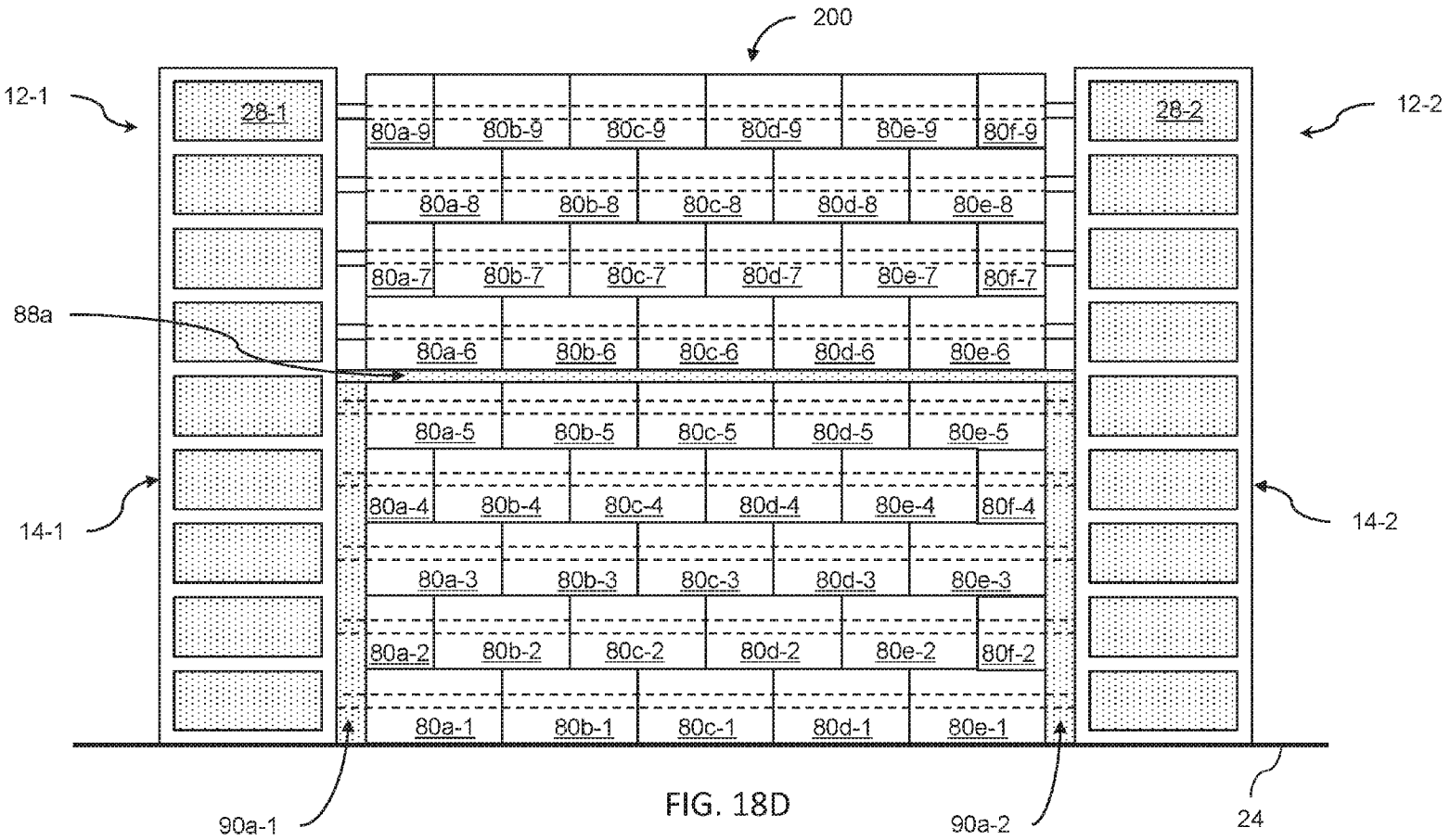

As shown in FIG. 18D, four additional rows of blocks (i.e., a sixth, seventh, eighth, and ninth row) are deployed on top of the first five rows of blocks. As with the first five rows of blocks, each additional row of blocks is deployed and securely aligned with the concrete columns 28-1, 28-2 in accordance with the above description and FIGS. 17A-17E. The sixth row of blocks includes blocks 80*a*-6, 80*b*-6, 80*c*-6, 80*d*-6, 80*e*-6, the seventh row of blocks includes blocks 80*a*-7, 80*b*-7, 80*c*-7, 80*d*-7, 80*e*-7 80*f*-7, the eighth row of blocks includes blocks 80*a*-8, 80*b*-8, 80*c*-8, 80*d*-8, 80*e*-8, and the ninth row of block includes blocks 80*a*-9, 80*b*-9, 80*c*-9, 80*d*-9, 80*e*-9, 80*f*-7. The corresponding connector beams 62, with abutting surfaces obscured by the rows of blocks, are shown in phantom, while the connector beams 70 are not shown.

Figure 18E:
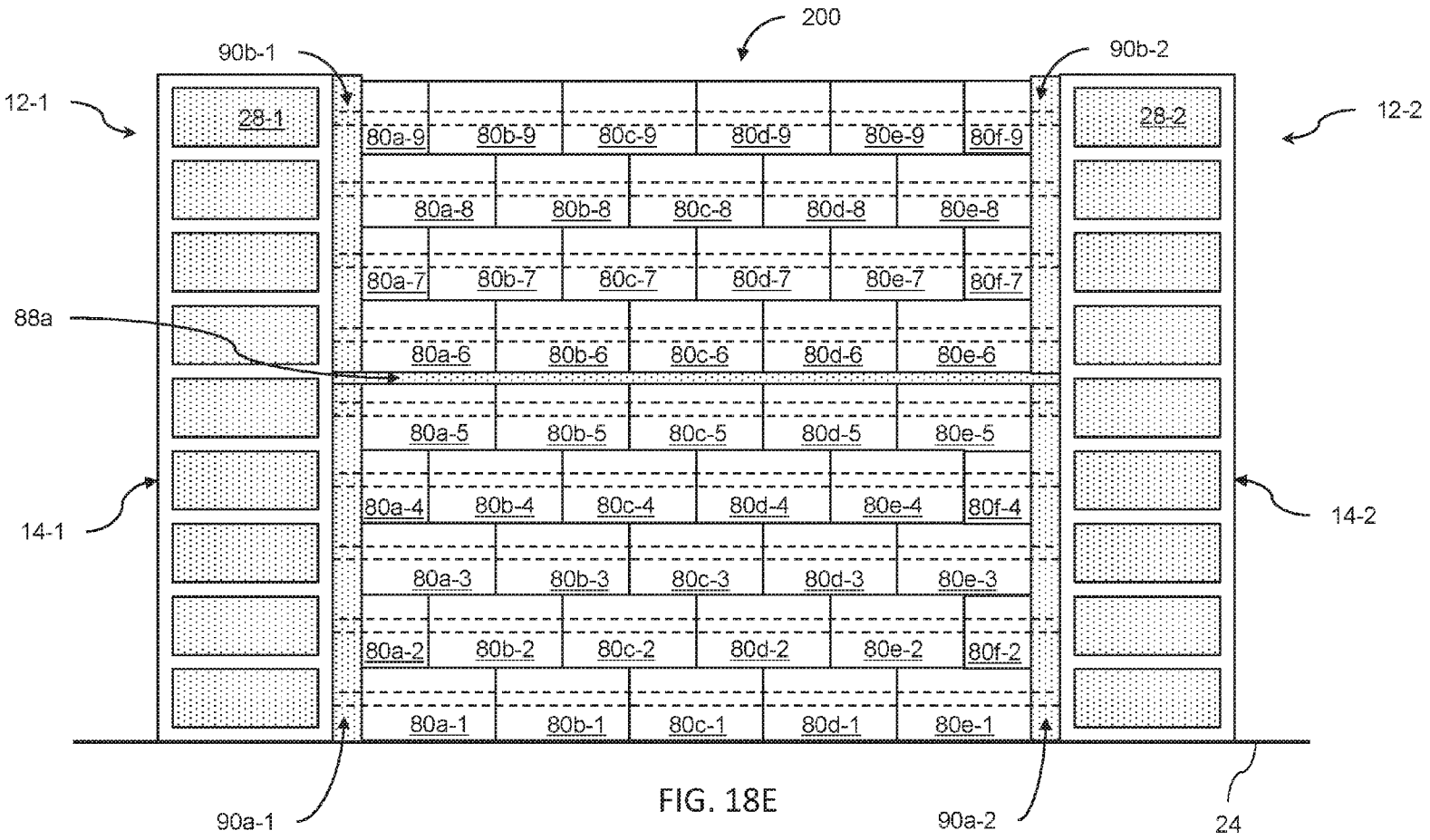

As with the first five rows of blocks, gaps are initially present between the last four rows of blocks and the concrete columns 28-1, 28-2. A cement based mixture is poured into these gaps and allowed to set, thereby securely connecting the last four rows of blocks to the concrete columns 28-1, 28-2. As shown in FIG. 18E, a formed concrete section 90*b*-1 fills the gap that was between the last four rows of blocks and the first concrete column 28-1, thereby securing the last four rows of blocks to the first concrete column 28-1. Similarly, a formed concrete section 90*b*-2 fills the gap that was between the last four rows of blocks and the second concrete column 28-2, thereby securing the last four rows of blocks to the first concrete column 28-2.

Figure 18F:
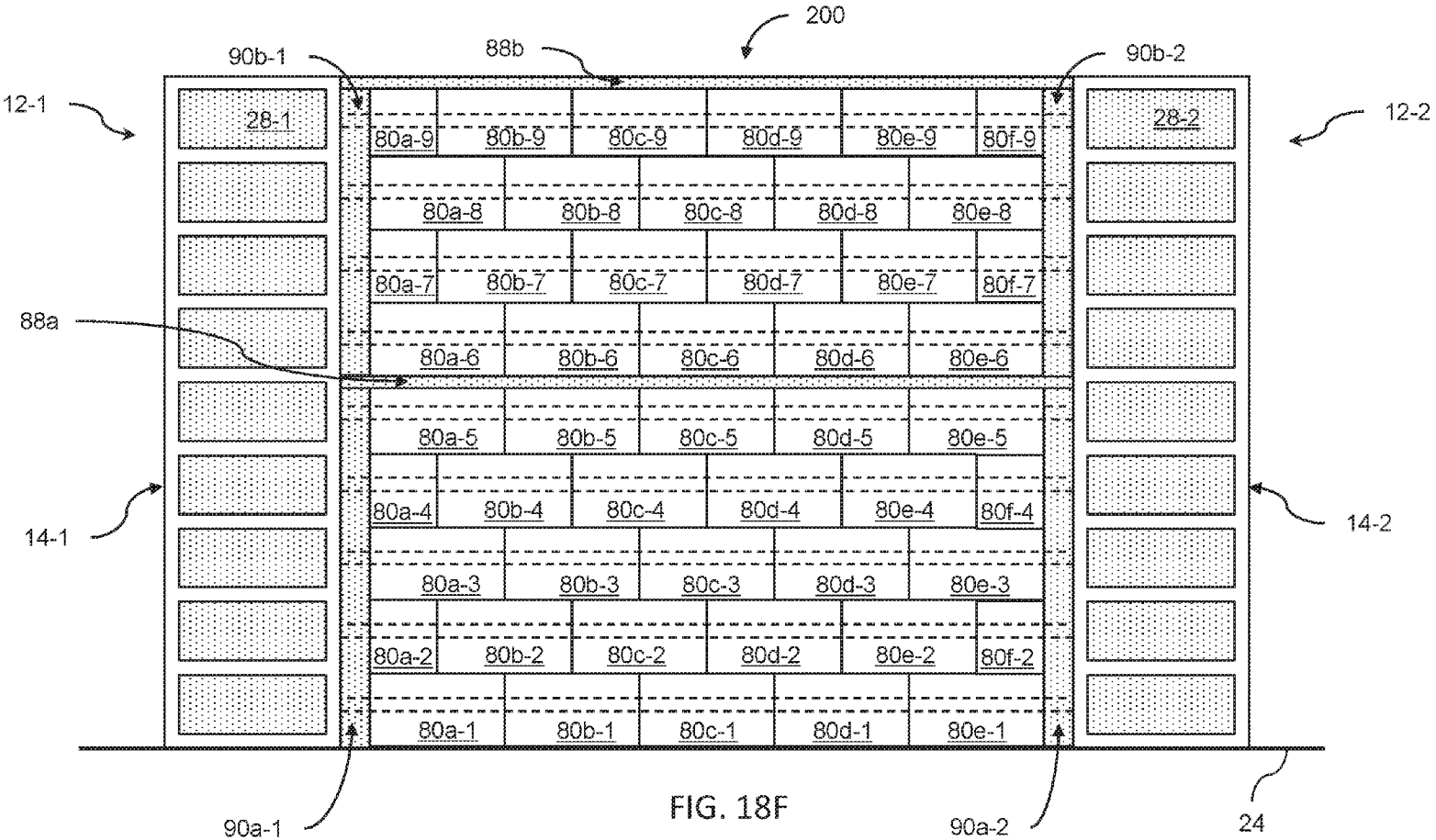
Figure 19:
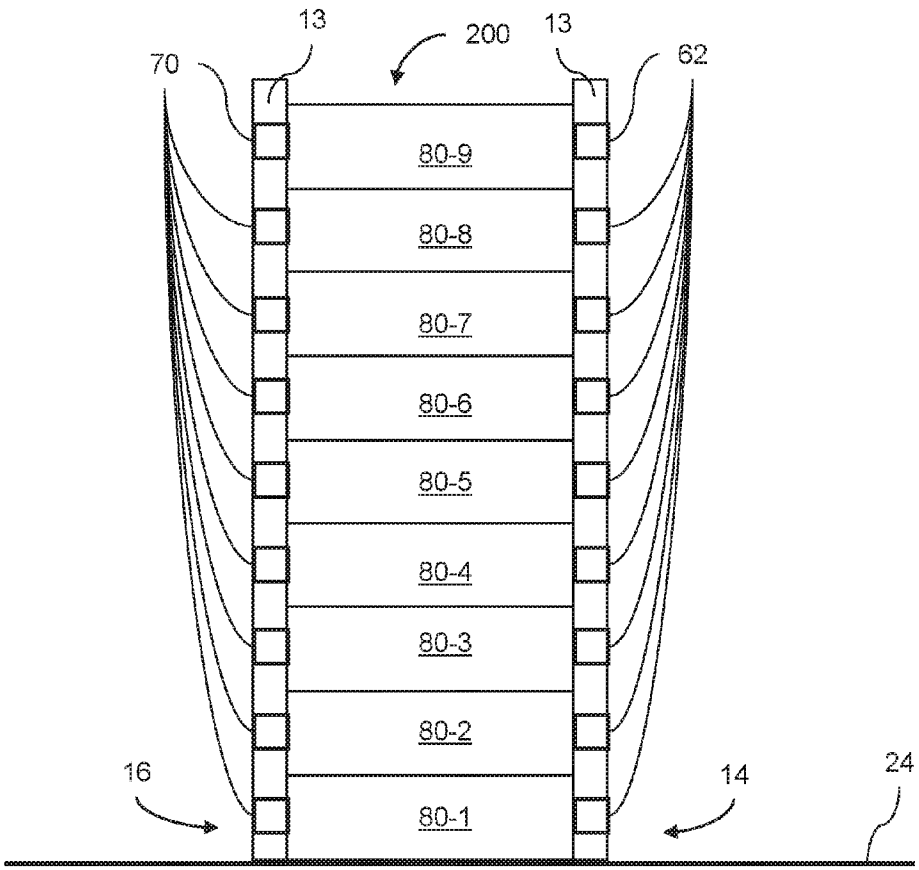
FIG. 19 is a side sectional view illustrating a schematic representation of layers of construction blocks deployed between a pair of frame members, each having multiple connectors beams coupled thereto for retaining the construction blocks, according to the teachings of an embodiment of the present invention.

As shown in FIG. 18F, a second strip of concrete 88*b* formed from a cement based mixture, is laid on top of the last (i.e., ninth) row of blocks, to further fortify the wall 200, and complete the block-based construction of the wall 200. FIG. 19 depicts a side sectional view illustrating the completed block-based construction of the wall 200, with nine rows of blocks 80-1, 80-2, 80-3, 80-4, 80-5, 80-6, 80-7, 80-8, 80-9 arranged in a stack, positioned between nine pairs of connector beams 62, 70 connected to frame members 14, 16.

Subsequent to completion of the block structure of the wall 200, the connector beams 62, 70 may be removed, followed by removal of the frame module(s) 12, 30. The frame module(s) 12, 30 may be removed by removing the fastening and tightening mechanisms 94, to allow the frame members of the frame module(s) 12, 30 to decouple from each other and the contour (i.e., the formed concrete column 28). Additional insulation may then be added to the external surfaces of the block-based wall 200, and the wall 200 may be finished with spackle and/or paint.

As mentioned above, the choice for the amount of vertical spacing between the longitudinal axis of adjacent connector beams is preferably based on the dimensions of the blocks to be laid, and the thickness (i.e., along the axis perpendicular to the base construction surface) of the connector beams. The thickness of the connector beams 62, 70 dictates how many rows of blocks are positioned between a pair of connector beams 62, 70. The illustration of block laying depicted in FIGS. 17A-18F shows a non-limiting exemplary deployment in which a one-to-one relationship exists between the connector beams 62, 70 and the rows of blocks. In other words, the non-limiting exemplary deployment illustrated in FIGS. 17A-18F shows each row of blocks positioned between a respective pair of connector beams 62, 70. It is noted that other connector beam-to-row relationships may be implemented. For example, if the thickness of the connector beams and/or the vertical spacing between the longitudinal axis of adjacent connector beams is adjusted, each row of blocks may be positioned between two or more respective pairs of connector beams 62, 70. Similarly, if the thickness of the connector beams is increased, multiple rows of blocks may be positioned between a single pair of connector beams 62, 70. In fact, if the thickness of the connector beams is increased to approximately match the height of the frame modules, all of the rows of blocks may be positioned between a single pair of connector beams 62, 70.

As noted, the above description of the construction assembly 10 with reference to FIGS. 17A-17E is a non-limiting exemplary illustration of the structure and operation of the construction assembly 10, for constructing a wall which extends between two concrete columns encased by two separate straight frame modules 12. As mentioned above, the description of the structure and operation of the construction assembly 10 with reference to FIGS. 17A-17E is for clarity of illustration. As should be apparent to one of skill in the art, similar principles can be applied to construct a wall which extends between a concrete column encased by a straight frame module 12 and a concrete column encased by an L-frame module 30 (i.e., a single corner), or a wall which extends between two concrete columns encased by two separate L-frame modules 30 (i.e., between two corners). As such, either or both of the straight frame modules 12-1, 12-2 of FIGS. 17A-17E could be replaced with an L-frame module 30.

Considering, for example, replacement of the second straight frame module 12-2 with an L-frame module 30, with the deployment of the L-frame module 30 being according to the schematic illustration provided in FIGS. 7A-7B or FIGS. 8A-8B.

In the case of the deployment illustrated in FIGS. 7A-7B, the second concrete column 28-2 may additionally be rotated ninety degrees clockwise. In the case where no rotation of the second concrete column 28-2 is present, the surface 23 of the contour of the first concrete column 28-1 and the surface 23 of the contour of the second concrete column 28-2 are coplanar, and the surface 26 of the contour of the first concrete column 28-1 and the surface 26 of the contour of the second concrete column 28-2 are coplanar.

In the case where rotation of the second concrete column 28-2 is present, the surface 23 of the contour of the first concrete column 28-1 and the surface 27 of the contour of the second concrete column 28-2 are coplanar. However, the plane in which the surface 26 of the contour of the first concrete column 28-1 lays, is perpendicular to the plane in which the surface 23 of the contour of the second concrete column 28-2 lays, and is also perpendicular to the plane in which the surface 26 of the contour of the second concrete column 28-2 lays.

In the case of the deployment illustrated in FIGS. 8A-8B, the connector beam 62 may be deployed so as to extend between the first frame member 14-1 and the first segment 34*a*, with the connector beam 70 correspondingly extending between the second frame member 16-1 and the first segment 38*a*. In such a case, the surface 23 of the contour of the first concrete column 28-1 and the surface 23 of the contour of the second concrete column 28-2 are coplanar, and the surface 26 of the contour of the first concrete column 28-1 and the surface 26 of the contour of the second concrete column 28-2 are coplanar.

Further to the case of the deployment illustrated in FIGS. 8A-8B, the connector beam 62 may alternatively be deployed so as to extend between the first frame member 14-1 and the second segment 34*b*, with the connector beam 70 correspondingly extending between the second frame member 16-1 and the second segment 38*b*. In such a case, the surface 23 of the contour of the first concrete column 28-1 and the surface 27 of the contour of the second concrete column 28-2 are coplanar, and the surface 26 of the contour of the first concrete column 28-1 and the surface 29 of the contour of the second concrete column 28-2 are coplanar.

As should be apparent to one of skill in the art, regardless of the contour shapes and the types of frame modules between which the connector beams 62, 70 laterally extend, the connector beam 62 is aligned with corresponding segments of the first frame members, and the connector beam 70 is aligned with corresponding segments of the second frame members, with the pair of the connector beams 62, 70 being parallel to each other in a plane that is coplanar with the base construction surface.

As described thus far, the construction assembly 10 has pertained to the deployment of blocks placed in a row between connector beams 62, 70 to effectuate proper alignment with the contours of concrete columns. In order to ensure proper vertical alignment of the rows of blocks of the block-based constructed wall 200, an alignment mechanism may be deployed on both sides of the wall 200, prior to, or during construction of the wall 200, and adjusted intermittently as the construction of the wall 200 progresses. Such a mechanism may also reinforce the wall 200 as it is being constructed.

Figure 20:
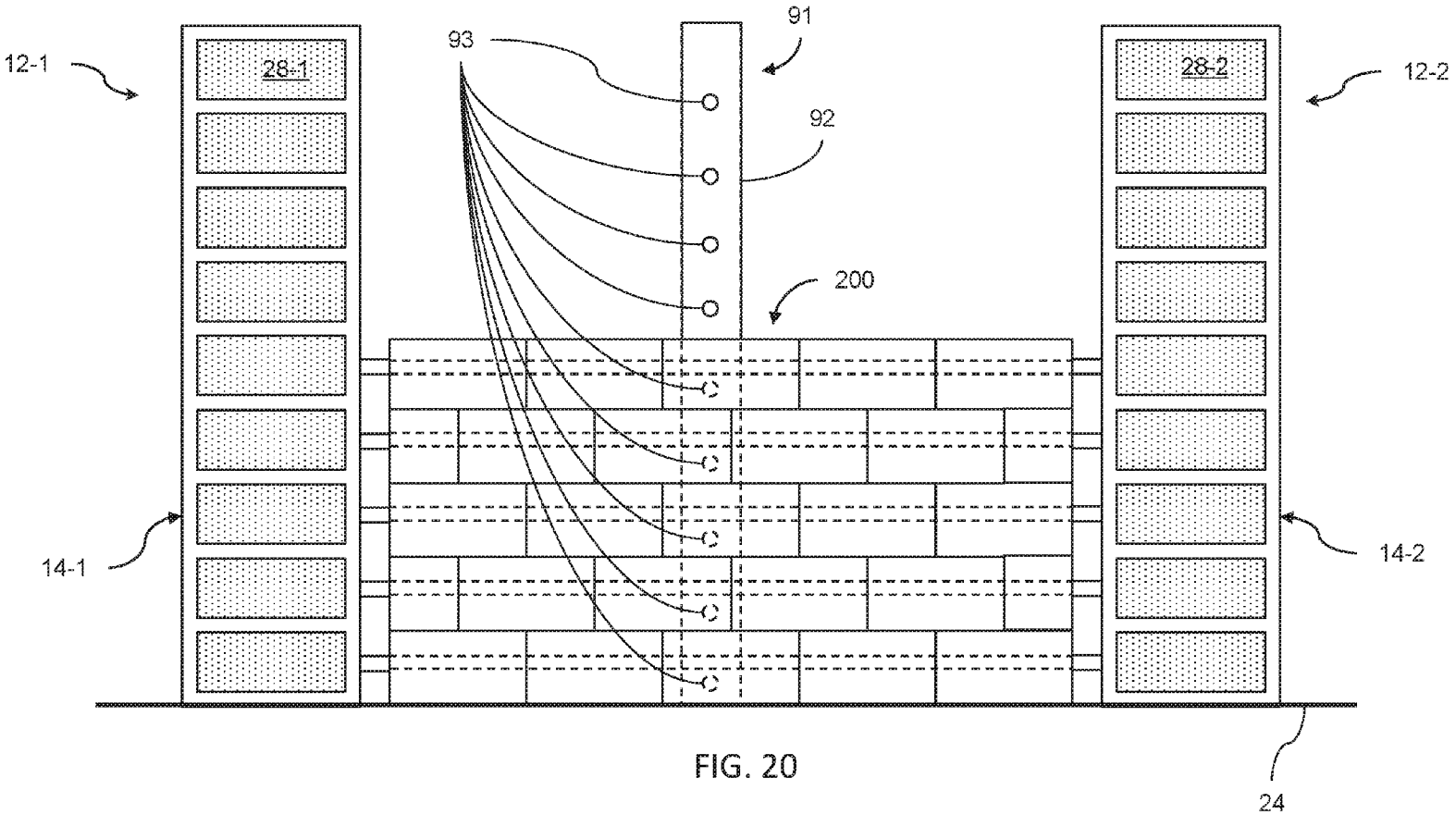
FIG. 20 is a front view illustrating a schematic representation of an alignment mechanism for further aligning the layered rows of construction blocks, according to the teachings of an embodiment of the present invention.
Figure 21:
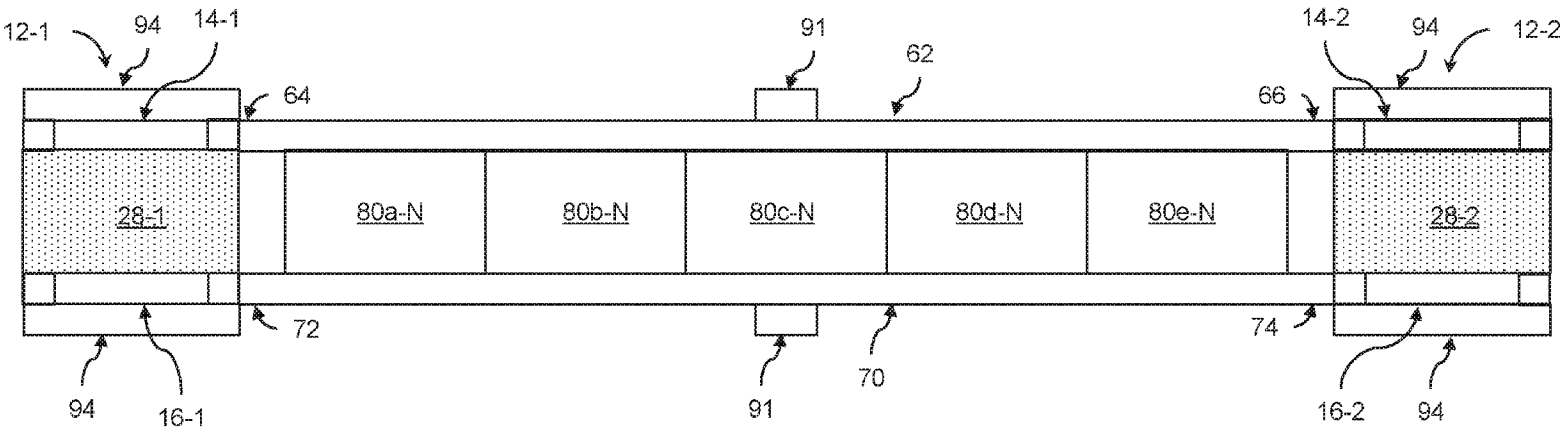
FIG. 21 is a top view illustrating a schematic representation of at least one row of construction blocks deployed between two frame modules partially encasing a concrete column, with a pair of frame module fastening and tightening mechanisms and a pair of alignment mechanisms, according to the teachings of an embodiment of the present invention.

With continued reference to FIGS. 1-19, refer now to FIGS. 20 and 21, deployment of an alignment mechanism 91 for aligning and stabilizing the wall 200 during construction. The alignment mechanism 91 includes an elongated base portion, and is preferably constructed from a strong and durable metallic material, most preferably iron. As shown in FIG. 21, respective alignment mechanisms 91 are positioned opposite to each other on opposing sides of the wall 200. Each alignment mechanism 91 includes an elongated base portion 92 that is positioned perpendicular to the base construction surface 24. The height of the base portion 92 is approximately equal to the height of the frame members of the frame module(s) 12, 30. A series of holes 93 are situated in the base portion 92 and are evenly spaced along the height of the base portion 92, in a manner similar to the holes 100 of the fastening and tightening mechanism 94. The alignment mechanism 91 operates in a similar manner as the fastening and tightening mechanism 94. Once positioned on opposing sides of the wall 200, a series of holes are made in the blocks of the wall 200, by, for example, drilling, at positions along the wall 200 which align with the respective holes 93 of the alignment mechanisms 92. A bolt may then be threaded through aligned holes 93 of opposing alignment mechanisms 91, and fastened with a bolt. The alignment mechanism 91 may be adjusted by sequential tightening adjustment of the respective fastening bolts that are threaded through the respective holes 93 at different height intervals.

As a result, any misalignment of the blocks of the wall 200 may be reduced by the above-mentioned adjustment via the alignment mechanism 91.

In the non-limiting example illustrated in FIG. 20, alignment of the first five rows of blocks of the wall 200 may be effectuated by tightening adjustment of any or all of the respective fastening bolts that are threaded through the five holes 93 closest to the base construction surface 24. As should be apparent, the number of holes 93 and the number of rows of blocks are not required to necessarily be equal.

Additionally, although not shown in the drawings, multiple pairs of alignment mechanisms 91 may be deployed along the width of the wall 200 between the concrete columns 28-1, 28-2, to further facilitate alignment and adjustment of the wall 200.

As should be apparent, the relative positioning of the blocks and rows of blocks are made in accordance with structural plans (i.e., architectural and engineering plans), and may include gaps and non-continuous sections to accommodate the inclusion of structures, such as, for example, doors, windows, hallways, passageways, and the like. Such non-continuous sections may be effectuated by a frame or the like for accommodating the placement of a window frame.

Figure 22:
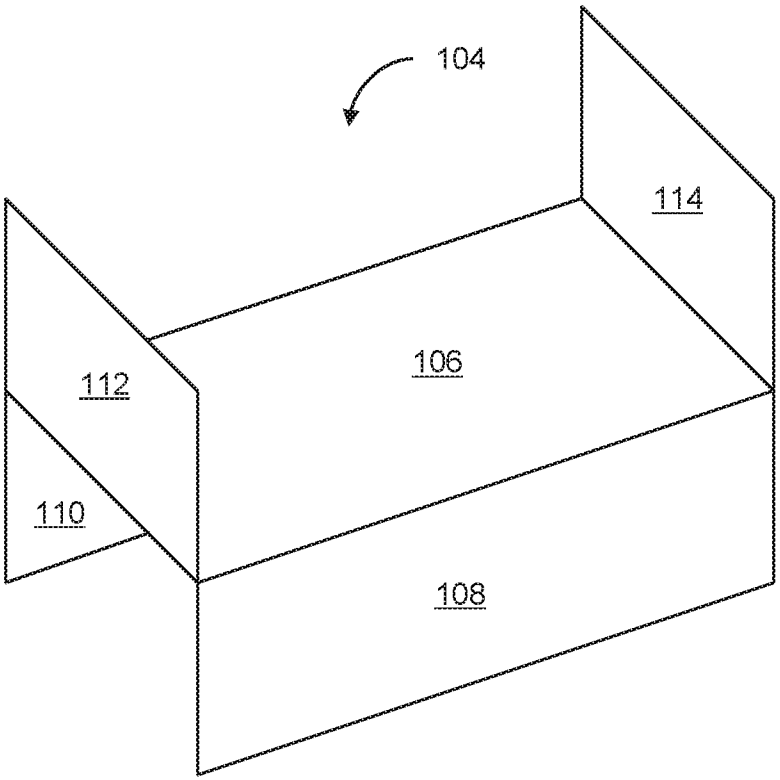
FIG. 22 is an isometric view illustrating a schematic representation of a window frame setting, according to the teachings of an embodiment of the present invention.
Figure 23:
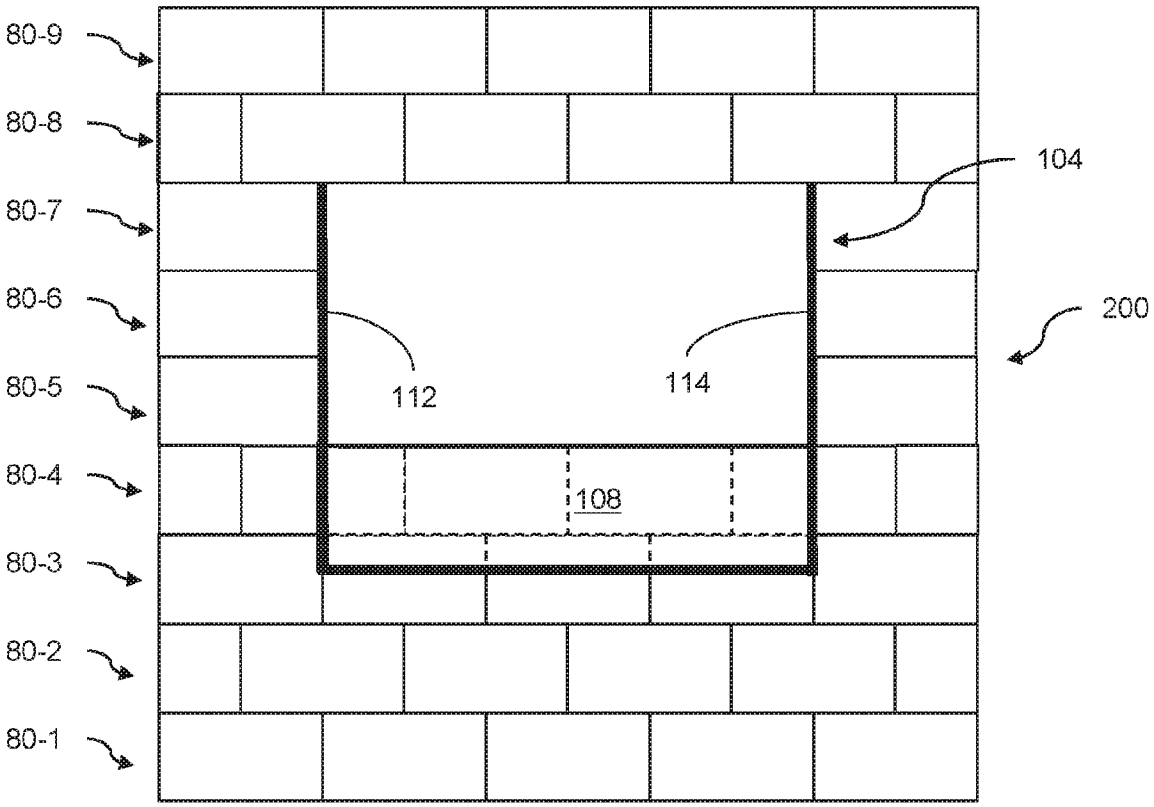
FIG. 23 is a side view illustrating a schematic representation of the deployment of the window frame setting between layered rows of construction blocks, according to the teachings of an embodiment of the present invention.

With continued reference to FIGS. 1-21, refer now to FIGS. 22 and 23, a window setting 104 of the construction assembly 10, for providing a fitting for window frames in a block-based wall under construction. The window setting 104 includes a base panel 106 and two pairs of framing panels attached thereto. The base panel 106 is dimensioned according to the depth (I)) of the blocks used to construct the wall. For example, if the blocks of the wall 200 each have a depth of 20 cm (yielding a 20-cm thick wall), the base panel 106 also has a depth of 20 cm. The length of the base panel 106 is proportionate to the combined lengths of multiple blocks in a single row. For example, if the window to be set (including the window frame) is 1 meter wide, the length of the base panel 106 is also 1 meter, which is the equivalent of five blocks if each block is 20 cm in length.

The first pair of framing panels includes a first downward panel 108 and a second downward panel 110. The panels 108, 110 are perpendicular to the base panel 106, and extend downward from edges of the base panel 106 along the height of the wall 200. The second pair of framing panels includes a first upward panel 1112 and a second upward panel 114. The panels 112, 114 are perpendicular to the base panel 106 and the panels 108, 110, and extend downward from edges of the base panel 106 along the height of the wall 200, in a plane parallel to the surfaces 86, 87 of the blocks.

The window setting 104 is positioned on top of one of the rows of blocks of the partially constructed wall 200 such that the panels 108, 110 slide onto the front and rear sides of the wall. Non-continuous rows above that row of blocks is completed, with some of the blocks of the non-continuous rows being at direct abutments with one of the panels 112, 114.

In the non-limiting example of FIG. 23 the window setting 104 is positioned on top of the fourth rows of blocks 80-4. The window setting 104 is then slid into contact with the first block of the fifth row of blocks 80-5, which is positioned above the first block of the fourth row of blocks 80-4. The panel 112 and the surface 87 of the first block of the fifth row of blocks 80-5 are at a direct abutment. Subsequently, the remaining rows of blocks are completed, in accordance with the block-laying techniques described in detail above. In the non-limiting example of FIG. 23, this includes positioning the first blocks of the sixth and seventh rows of blocks 80-6, 80-7 such that the surface 87 of those blocks and the panel 112 are at a direct abutment, and such that surface 86 of the last blocks of the fifth, sixth, and seventh rows of blocks 80-5, 80-6, 80-7 and the panel 114 are at a direct abutment.

The panels 108, 110 may then be folded upward towards the base panel 106, and the window setting 104 may be slideably removed from the wall 200, and replaced by a correspondingly dimensioned window frame. The remaining rows of blocks, which in the non-limiting example of FIG. 23 includes the eighth and ninth rows of blocks 80-8, 80-9, may then be laid in accordance with the block-laying techniques described in detail above.

In operation, the components of the construction assembly 10 are deployed in accordance with detailed architectural and engineering design plans, to maximize the efficiency of construction and reduce alignment error of the walls of the structure under construction. For example, prior to the deployment of the frame modules 12, 30, precise geographic location information (via, for example, GPS) and dimensions of the structure to be constructed are provided. Such information includes the positioning and dimensions of the contours of the concrete columns to be constructed. Such information aides in the proper positioning of the frame modules during deployment, and helps to ensure the proper alignment of the walls of the structure under construction.

Once the architectural and engineering design plans are provided, the block-based walls of the structure can be constructed based on the design specifications (i.e., number of concrete columns, shape of the contours of the concrete columns, number of walls, length of each wall, height of each wall, corners sections formed by walls, etc.). To further illustrate the structure and operation of the construction assembly 10 of the present disclosure, the step by step process for constructing a single section of wall, based on the design specifications of that section of wall, will now be provided.

In a first step, a first frame module (either straight frame module 12 and L-frame module 30) is deployed to attach to the contour of a first concrete column, and a second frame module (either straight frame module 12 and L-frame module 30) is deployed to attach to the contour of a second concrete column (FIGS. 6A-8B, and 12). The two concrete columns serve as anchors for a section of a block-based wall. The concrete columns may then be set in the respective contours, via pouring and setting of the above-mentioned cement base mixture. As noted above, the contours may be constructed from wood or tin, and preferably have a rectangular, square, or L-shaped projection.

Next, the attachment mechanisms 50 are deployed at appropriate height intervals via attachment to the appropriate side bars 18, **40*a*, 40*b*, 44*a*, 44*b* (FIGS. 13-14). The connector beams 62 are then attached to connect segments of the first frame members of the two frame modules to each other (FIG. 16). As discussed above, the planar surface 68 of each of the connector beams 62 are coplanar (or nearly coplanar). Additionally, and further to as discussed above, the planar surface 68 of each of the connector beams 62** are also coplanar, or nearly coplanar, with appropriate contact surfaces of the first frame members and the contours.

At any point, the spacing between the frame members of either or both of the frame modules may be adjusted, to adjust the alignment of the connector beams 62 in order to achieve the above-mentioned coplanar conditions. As discussed in detail above, the adjustment may be effectuated by tightening adjustment of any or all of respective fastening bolts threaded through holes disposed in the concrete columns. The first row of blocks is then laid, as described above with reference to FIGS. 17A-17C. Next, one of the connector beams 70 is attached to the second frame members of the two frame modules, as described above with reference to FIGS. 17D-17E, opposite the connector beam 62 abutting the first row of blocks. Once the first row of blocks is properly aligned with the two concrete columns, the next row of blocks is laid on top of the first row of blocks. This process is repeated until a completed block-based wall is constructed, with pairs of connector beams 62, 70 abutting opposing surfaces of the blocks in each row, and with strategically placed reinforcing strips of concrete positioned between certain rows, and gaps between the blocks and the columns filled with concrete (FIG. 18E).

As a result of the deployment of the construction assembly 10, the planar surface 82 the blocks in the constructed wall are coplanar, or nearly coplanar with a minute margin of error, typically on the order of less than 5 millimeters. Additionally, the planar surface 82 the blocks in the constructed wall, and at least one surface of the contour of each of the concrete columns between which the constructed wall extends, are coplanar (or nearly coplanar).

Although the construction assembly as described thus far has pertained to straight frame modules and L-frame modules which are attached to contours of concrete columns which serve as anchors for sections of block-based sections of a wall, fully or partially constructed block-based walls may also serve as such anchors. In other words, straight frame modules and L-frame modules may be attached to fully or partially constructed block-based walls, as a way to extend existing block-based walls, or construct new block-based walls, as should be appreciated by one of skill in the art.

Although the construction assembly as described thus far has pertained to connector beams implemented as elongated cuboids (rectangular or square cuboids) configured to be attached to frame members via multi-surfaced attachment mechanisms, other embodiments are possible in which the connector beams are generally cuboid in shape but include protruding portions at the ends. In such an embodiment, the portions of the frame members to which the connector beams are attached may be correspondingly configured indented receiving portions, and the attachment mechanism for attaching the connector beams to the frame members may be implemented as single surface shelf-like structure onto which the protruding portions of the connector beams may rest. Accordingly, in such an embodiment, the protruding portion at the end of a connector beam may inserted into the indented receiving portion of the frame member, to facilitate a flush coupling of the connector beam to the frame member.

It should also be noted that, in some alternative implementations, the steps of the methods according to various embodiments of the present invention may be performed alternatively to the order as described above. For example, two steps which were described above as being performed in succession may, in fact, be performed substantially concurrently, or the steps may sometimes be performed in the reverse order, depending upon the functionality involved. Additionally, a single step may be performed as a series of sub-steps, performed sequentially or in parallel, depending upon the functionality involved.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

As used herein, the singular form, "a", "an" and "the" include plural references unless the context clearly dictates otherwise.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A construction assembly comprising:

a first frame module comprising a first frame member including a segment for contacting a first surface of a contour of a first column;

a second frame module comprising a first frame member including a segment for contacting a first surface of a contour of a second column substantially aligned with the first surface of the contour of the first column; and at least one first connector beam including first and second end portions and a planar surface substantially perpendicular to a base surface from which the first and second columns extend, the first end portion operatively coupled to the first frame member of the first frame module, and the second end portion operatively coupled to the first frame member of the second frame module, the at least one first connector beam substantially aligned with, and extending laterally between, the first frame members of the first and second frame modules, the at least one first connector beam receiving at least one block such that the planar surface is at a direct abutment with a first planar surface of the at least one block.

2. The construction assembly of claim 1, further comprising:

at least one first frame module attachment mechanism coupled to the first frame member of the first frame module for facilitating the operative coupling of the first end portion to the first frame member of the first frame module; and at least one second frame module attachment mechanism coupled to the first frame member of the second frame module for facilitating the operative coupling of the second end portion to the first frame member of the second frame module.

3. The construction assembly of claim 2, wherein the at least one first frame module attachment mechanism is coupled to the first frame member of the first frame module at an adjustable position along an axis substantially perpendicular to the base surface, and wherein the at least one second frame module attachment mechanism is coupled to the first frame member of the second frame module at an adjustable position along an axis substantially perpendicular to the base surface.

4. The construction assembly of claim 2, wherein the at least one first frame module attachment mechanism includes a plurality of first frame module attachment mechanisms, each coupled to the first frame member of the first frame module at an adjustable position along an axis substantially perpendicular to the base surface, and wherein the at least one second frame module attachment mechanism includes a plurality of second frame module attachment mechanisms, each coupled to the first frame member of the second frame module at an adjustable position along an axis substantially perpendicular to the base surface.

5. The construction assembly of claim 4, wherein the at least one first connector beam includes a plurality of first connector beams, each first end portion of the first connector beams being operatively coupled to a respective one of the first frame module attachment mechanisms, and each second end portion of the first connector beams being operatively coupled to a respective one of the second frame module attachment mechanisms.

6. The construction assembly of claim 1, wherein the first frame module further comprises a second frame member including a segment for contacting a second surface of the contour of the first column, and wherein the second frame module further comprises a second frame member including a segment for contacting a second surface of the contour of the second column, and wherein at least one of the second surface of the contour of the first column is oppositely disposed from the first surface of the contour of the first column or the second surface of the contour of the second column is oppositely disposed from the first surface of the contour of the second column.

7. The construction assembly of claim 6, further comprising:

at least one second connector beam including first and second end portions and a planar surface substantially perpendicular to the base surface and parallel to the planar surface of the at least one first connector beam, the first end portion of the at least one second connector beam operatively coupled to the second frame member of the first frame module, and the second end portion of the at least one second connector beam operatively coupled to the second frame member of the second frame module, the at least one second connector beam substantially aligned with, and extending laterally between, the second frame members of the first and second frame modules, the at least one second connector beam positioned such that the planar surface of the at least one second connector beam is at a direct abutment with a second planar surface of the at least one block, the first and second planar surfaces of the at least one block being oppositely disposed.

8. The construction assembly of claim 6, wherein the first and second frame members of the first frame module are deployed in spaced relation so as to at least partially encase the contour of the first column, and wherein the first and second frame members of the second frame module are deployed in spaced relation so as to at least partially encase the contour of the second column.

9. The construction assembly of claim 8, further comprising:

at least one first frame module fastening and tightening mechanism for coupling the first and second frame members of the first frame module to each other, and for adjusting the spacing between the first and second frame members of the first frame module; and at least one second frame module fastening and tightening mechanism for coupling the first and second frame members of the second frame module to each other, and for adjusting the spacing between the first and second frame members of the second frame module.

10. The construction assembly of claim 1, wherein at least one of the first frame member of the first frame module or the first frame member of the second frame module includes a second segment axially joined with the segment for contacting the first surface of the contour of the respective column so as to form a substantially perpendicular joint.

11. The construction assembly of claim 1, wherein at least one of the contours of the first and second columns is formed from a material selected from the group consisting of: wood, tin, or concrete.

12. A construction assembly comprising:

a first pair of frame members contacting oppositely disposed surfaces of a contour of a first column so as to at least partially encase the contour of the first column;

a second pair of frame members contacting oppositely disposed surfaces of a contour of a second column so as to at least partially encase the contour of the second column; and a pair of connector beams, each of the connector beams including a planar surface substantially perpendicular to a base surface from which the first and second columns extend, one connector beam of the pair of connector beams being substantially aligned with, and extending laterally between, one frame member of the first pair of frame members and one frame member of the second pair of frame members, the other connector beam of the pair of connector beams being substantially aligned with, and extending laterally between, the other frame member of the first pair of frame members and the other frame member of the second pair of frame members, the pair of connector beams being deployed such that, the planar surface of one connector beam of the pair of connector beams is at a direct abutment with a first planar surface of at least one block, and such that the planar surface of the other connector beam of the pair of connector beams is at a direct abutment with a second planar surface of the at least one block.

* * * * *